US006983695B2

(12) United States Patent
Mogi et al.

(10) Patent No.: US 6,983,695 B2
(45) Date of Patent: Jan. 10, 2006

(54) PRINTING METHOD, PRINTED MATTER, AND PRINTING CONTROL DEVICE

(75) Inventors: Masao Mogi, Tokyo (JP); Yoshikazu Shimamura, Tokyo (JP); Takashi Ichinose, Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 0 days.

(21) Appl. No.: 10/762,286

(22) Filed: Jan. 23, 2004

(65) Prior Publication Data

US 2004/0159254 A1 Aug. 19, 2004

Related U.S. Application Data

(63) Continuation of application No. PCT/JP02/10678, filed on Oct. 15, 2002.

(30) Foreign Application Priority Data

| | | |
|---|---|---|
| Oct. 15, 2001 | (JP) | 2001-316453 |
| Mar. 29, 2002 | (JP) | 2002-094456 |
| Mar. 29, 2002 | (JP) | 2002-094457 |
| Mar. 29, 2002 | (JP) | 2002-094458 |

(51) Int. Cl.
*B41F 33/00* (2006.01)

(52) U.S. Cl. ..... 101/484; 101/483; 101/171; 101/211

(58) Field of Classification Search ..... 101/483–485, 101/171, 181, 211, 350, 365
See application file for complete search history.

(56) References Cited

U.S. PATENT DOCUMENTS

| | | | | |
|---|---|---|---|---|
| 4,852,485 | A | 8/1989 | Brunner | 101/211 |
| 4,947,746 | A | 8/1990 | Jeschke et al. | 101/211 |
| 5,031,534 | A | 7/1991 | Brunner | 101/365 |
| 5,748,331 | A * | 5/1998 | Kohler | 358/302 |
| 5,791,249 | A * | 8/1998 | Quadracci | 101/450.1 |
| 6,446,555 | B1 * | 9/2002 | Schramm et al. | 101/365 |
| 2004/0159254 | A1 * | 8/2004 | Mogi et al. | 101/484 |

FOREIGN PATENT DOCUMENTS

| | | |
|---|---|---|
| JP | 61-40159 | 2/1986 |
| JP | 4-18847 | 4/1992 |
| JP | 28-31107 | 9/1998 |
| JP | 2000-127348 | 5/2000 |
| JP | 2001-80052 | 3/2001 |

OTHER PUBLICATIONS

Masao Mogi, et al., "The Relationship between the Dot Area Monitored and Printing Quality in Offset Lithography", TAGA (Technical Association of the Graphic Arts), 2000 Proceedings.

* cited by examiner

*Primary Examiner*—Minh Chau

(57) ABSTRACT

Color densities of patches included in a control strip are measured to perform printing control based on the color densities. The patches are arranged in the same direction as the arrangement of ink keys of a printing device. The patches include four typical patches of black, cyan, magenta, and yellow at area rates of 60 to 85% in the width of each ink key. The printing control is the control for keeping the color densities of the four typical patches of the width of each ink key in predetermined color-density ranges.

35 Claims, 10 Drawing Sheets

PRINTING METHOD, PRINTED MATTER, AND PRINTING CONTROL DEVICE

CROSS-REFERENCE TO RELATED APPLICATIONS

This is a Continuation Application of PCT Application No. PCT/JP02/10678, filed Oct. 15, 2002, which was not published under PCT Article 21(2) in English.

This application is based upon and claims the benefit of priority from the prior Japanese Patent Applications No. 2001-316453, filed Oct. 15, 2001; No. 2002-094456, filed Mar. 29, 2002; No. 2002-094457, filed Mar. 29, 2002; and No. 2002-094458, filed Mar. 29, 2002, the entire contents of all of which are incorporated herein by reference.

BACKGROUND OF THE INVENTION

1. Field of the Invention

The present invention relates to a printing method of measuring color densities of patches included in a control strip printed on a printed matter and inspecting or managing the printing quality, the printed material and a printing control device.

2. Description of the Related Art

To inspect or manage the printing quality, there is a printing method of printing a control strip for measuring the printing quality on a printed matter, measuring color densities of patches (color patch) included in the control strip, and performing printing control based on the measured color densities.

In the case of the printing method, an ink amount is generally inspected with solid patches of four colors such as K (black), C (cyan), M (magenta), and Y (yellow) which are basic colors of printing.

In this printing method, however, the following are not inspected: fluctuation of the dot gain value of a halftone dot to be printed, doubling in which a dot is multiply printed, and slur caused by friction of a dot. Therefore, when using this printing method, it is difficult to assure the quality of every color in a printed image.

As a printing method of solving the above problem, there is a method of inspecting or managing the printing quality by using a control strip including not only solid patches of K, C, M, and Y for inspecting an ink amount but also patches of K, C, M, and Y for inspecting the fluctuation of dot gains of K, C, M and Y.

The printing method using the control strip requires a space for the control strip on a printing sheet.

Therefore, the printing method using the control strip tends to be used for a sheet-fed printing which makes it easy to secure the space rather than an web offset printing which makes it difficult to secure the space for the control strip.

The printing method using the control strip is not frequently used for the web offset printing because of the above reason. However, because higher-quality printing is requested, management of the printing quality using the control strip is also studied on the web offset printing.

To apply the printing method using a control strip to the web offset printing, some systems are developed which use the slender control strip in a narrow space on a printing sheet.

In the case of offset printing, it is requested that patches to be measured printed on an a printed matter is thin and small. However, to accurately measure a color density, it is necessary to reduce that the color density of a patch to be measured is influenced by the color density of an adjacent another patch. Therefore, it is necessary to consider a resolution which can be measured by a measuring device for measuring a patch.

In general, an ink amount for offset printing is adjusted by several ink keys arranged in the direction perpendicular to the running direction of a printing sheet.

Ink amount is adjusted in accordance with the opening degree of blades divided by the number of inks to be used for printing.

When the running direction of a printing sheet does not correspond between a printed pattern and patches, it is impossible to obtain control information which is used to print the pattern.

Using an inspection method including a gray patch in which is a screen tint of three colors such as C, M, and Y in addition to patches of four colors such as K, C, M, and Y which are basic colors for printing, the quantity of information of the image to be printed is more than the case of using a method of performing an inspection with only ink amount of four colors such as K, C, M, and Y, and as a result, the quality of printed matter is stabilized.

This is because the control information on printing qualities (for example, balance of amount of inks of three colors such as C, M, and Y, dot gain, contrast, and trapping), which cannot be obtained from the inspection of quantities of amount of four colors such as K, C, M, and Y which are basic colors of printing, can be obtained from the inspection using the gray patch.

Among the above printing qualities, it is difficult to control trapping by adjusting normal ink or water during press running. Therefore, detection of trapping is generally used to check the state of a material or press machine.

Because most images to be placed on a publication printed matter or commercial printed matter are expressed by dots or multiplication of dots of two colors or more, dot gain and contrast greatly influence the printing quality.

Document 1 (U.S. Pat. No. 4,852,485) discloses a method of controlling inks of an offset printing machine in accordance with the data obtained by measuring patches of control strips printed on a printed matter.

In Document 1, a control strip includes at least one screen patch (screen-tint patch) and one solid patch each color zone (ink key zone). As one example, a screen patch at halftone-dot area rates of 60% for C, 50% for M, and 50% for Y is disclosed. Moreover, as another example, a screen patch at halftone-dot area of 50% for C, 41% for M, and 41% for Y is disclosed. Furthermore, a combination patch (3C gray) is included in the control strip. Document 1 discloses that screen tints at halftone-dot area rates of 25%, 50%, and 75% are used. Ink control is performed by using the calorimetric value of single color patches. The colorimetric value of the combination patch is compared with values in a color table and used for control target setting and determination.

Document 2 (U.S. Pat. No. 6,142,078) also discloses a method of controlling inks of an offset printing machine same as that disclosed in Document 1.

Document 2 does not disclose any patch included in a color bar (control strip). In Document 2, the calorimetric value of solid color patches are used for control.

Document 3 (Jpn. Pat. Appln. KOKAI Publication No. 2001-353851) discloses a method of calculating an optimum screen-tint area rate for a printing-quality control method using a screen-tint patch.

Document 3 discloses that it is preferable to keep the halftone-dot area rate of a screen-tint patch between 76 and 86%. Document 3 also discloses that screen-tint patches at a halftone-dot area rate of 76 to 86% should be included in a control strip.

A method of independently controlling each color by using single color solid patches of K, C, M, and Y has an advantage that a response speed until the color density of each color approaches target values is raised because control process is simple. However, because of the control for each color, it may take a long time until a printed matter having a quality as a commercial product is obtained or color balance may collapse in the case of an actual image expressed by a gray scale which is a combination of three colors.

In a method of including a gray patch obtained from screen tints of three colors such as C, M, and Y together in a control strip and performing control by using the gray patch, the quantity of information on a image to be printed increases compared to a method of inspecting only ink amount of four colors such as K, C, M, and Y which are basic colors for printing and performing control, and as a result, the printing quality is further stabilized. However, because the quantity of information is too much, a response speed tends to delay.

Because the balance between amount of inks of three colors such as C, M, and Y influences the hues reproduced by three colors, it greatly influences the printing quality.

By noticing the above point, Document 4 (Jpn. Pat. Appln. KOKAI Publication No. 2001-80052) discloses the invention for obtaining a printed matter close to a color sample by performing the control considering the balance between three colors such as C, M, and Y while measuring each single color patch.

BRIEF SUMMARY OF THE INVENTION

It is an object of the present invention to provide a printing method of improving the inspection accuracy or management accuracy of the printing quality and improving efficiencies of the control and operation for inspecting or managing the printing quality, printed matter, and printing control device.

First to fifth inventions relate to a printing method of printing a control strip including patches on a printed matter, measuring color densities of the patches, and performing printing control based on the color densities.

In the first invention, the patches are arranged in the same direction as the arrangement of ink keys of a printing device and include four typical patches of black, cyan, magenta, and yellow at dot area rates of 60 to 85% in the width of each ink key. The printing control is the control for keeping the color densities of the four typical patches of the width of each ink key in predetermined color-density ranges.

In the second invention, the patches are arranged in the same direction as the arrangement of ink keys of a printing device and include four typical patches of black at a dot area rate of 100% and cyan, magenta, and yellow at dot area rates of 60 to 85% in the width of each ink key. The printing control is the control for keeping the color densities of the four typical patches of the width of each ink key in predetermined color-density ranges.

In the third invention, the patches are arranged in the same direction as the arrangement of ink keys of a printing device, and include four solid patches of black, cyan, magenta, and yellow at dot area rates of 100% and four typical patches of black, cyan, magenta, and yellow at dot area rates of 60 to 85% in the width of each ink key. The printing control determines whether or not values obtained based on the color densities of the typical patches and the color densities of the solid patches are included in predetermined ranges on the four colors in the width of each ink key, and determines that printing is not normal when it is not determined that the values are included in the ranges.

In the fourth invention, the patches are arranged in the same direction as the arrangement of ink keys of a printing device, and include four solid patches of black, cyan, magenta, and yellow of dot area rates of 100% and four middle patches of black, cyan, magenta, and yellow at dot area rates of 40 to 50%. The patches also include four typical patches of black, cyan, magenta, and yellow at dot area rates of 60 to 85% in the width of each ink key. The printing control determines whether or not values obtained based on differences between the color densities of the solid patches and the color densities of the typical patches and differences between the color densities of the typical patches and the color densities of the middle patches are included in predetermined ranges in the width of each ink key on the four colors, and determines that printing is not normal when it is not determined that the values are included in the ranges.

In the fifth invention, color densities of four patches of black, cyan, magenta, and yellow included in the width of each ink key are measured. The color density of the patch of an optional color selected from cyan, magenta, and yellow and the color density of the patch of black are respectively kept in predetermined color-density ranges, and the ink keys are controlled for keeping a value showing the balance of the color densities of patches of cyan, magenta, and yellow in a predetermined range in the width of each ink key. The ink keys are controlled for respectively keeping the color densities of black, cyan, magenta, and yellow patches in the color-density ranges in the width of each ink key and a value showing the balance of the color densities of cyan, magenta and yellow patches is obtained at each predetermined cycle, after the value showing the balance enters in the range.

Sixth and seventh inventions relate to a printed matter on which a control strip including several patches is printed.

In the sixth invention, the patches are arranged in the same direction as the arrangement of ink keys of a printing device under printing, and include four typical patches of black, cyan, magenta, and yellow at dot area rates of 60 to 85% in the width of each ink key.

In the seventh invention, the patches are arranged in the same direction as the arrangement of ink keys of a printing device under printing, and include four typical patches of black at a dot area rate of 100% and cyan, magenta, and yellow at dot area rates of 60 to 85% in the width of each ink key.

Eighth to twelfth inventions relate to a printing control device for printing a control strip including several patches on a printed matter, measuring color densities of the patches, and performing printing control based on the color densities.

In the eighth invention, the patches are arranged in the same direction as the arrangement of ink keys of a printing device, and include four typical patches of black, cyan, magenta, and yellow at dot area rates of 60 to 85% in the width of each ink key. The eighth invention comprises a measuring section which measures the color densities of the patches, and a control section which performs the control for keeping the color densities of the four typical patches in predetermined color-density ranges in the width of each ink key.

In the ninth invention, the patches are arranged in the same direction as the arrangement of ink keys of a printing device, and include four typical patches of black at a dot area rate of 100% and cyan, magenta, and yellow at dot area rates of 60 to 85% in the width of each ink key. The ninth invention comprises a measuring section which measures the color densities of the patches, and a control section which performs the control for keeping the color densities of the four typical patches in predetermined color-density ranges in the width of each ink key.

In the tenth invention, the patches are arranged in the same direction as the arrangement of ink keys of a printing device, and include four solid patches of black, cyan, magenta, and yellow at dot area rates of 100%. The patches also include four types of typical patches of black, cyan, magenta, and yellow at dot area rates of 60 to 85% in the width of each ink key. The tenth invention comprises a measuring section which measures the color densities of the patches, and a control section which determines whether or not values obtained based on the color densities of the typical patches and the color densities of the solid patches are included in predetermined ranges about the four colors, and determines that printing is not normal when it is not determined that the values are included in the ranges.

In the eleventh invention, the patches are arranged in the same direction as the arrangement of ink keys of a printing device, and include four solid patches of black, cyan, magenta, and yellow at dot area rates of 100%, and four middle patches of black, cyan, magenta, and yellow at dot area rates of 40 to 50%. The patches also include four typical patches of black, cyan, magenta, and yellow at dot area rates of 60 to 85% in the width of each ink key. The eleventh invention comprises a measuring section which measures the color densities of the patches, and a control section which determines on the four colors whether or not values obtained based on differences between the color densities of the solid patches and the color densities of the typical patches and differences between the color densities of the typical patches and the color densities of the middle patches are included in predetermined ranges in the width of each ink key, and determines that printing is not normal when it is not determined the values are included in the ranges.

The twelfth invention comprises a measuring section which measures the color densities of the patches, and a control section which controls ink keys for respectively keeping the color density of the patch of an optional color selected from cyan, magenta, and yellow and the color density of the black patch in predetermined color-density ranges, and keeping a value showing the balance of the color densities of cyan, magenta, and yellow patches in a predetermined range in the width of each ink key, and controls the ink keys for respectively keeping the color densities of black, cyan, magenta, and yellow patches in the color-density ranges in the width of each ink key and obtaining a value showing the balance of the color densities of cyan, magenta, and yellow patches at each predetermined cycle, after the value showing the balance enters in the range.

DETAILED DESCRIPTION OF THE INVENTION

Embodiments of the present invention will be described below by referring to the accompanying drawings.

(First Embodiment)

In this embodiment, the following are described: a printing method of improving the printing quality by measuring a few patches and realizing efficient inspection or management and a printed matter for use in the printing method, and a printing control device.

Figure 1:
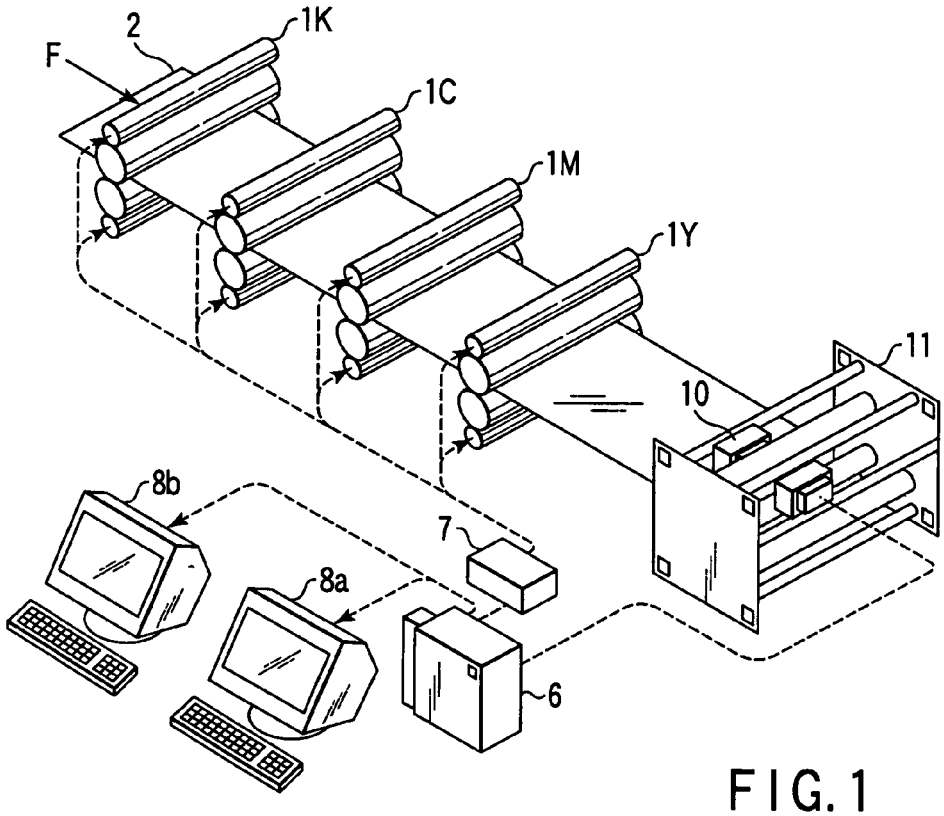
FIG. 1 is a perspective view showing the concept of a printing control device according to a first embodiment of the present invention.

FIG. 1 is a perspective view showing the concept of the printing control device according to this embodiment.

Figure 2:
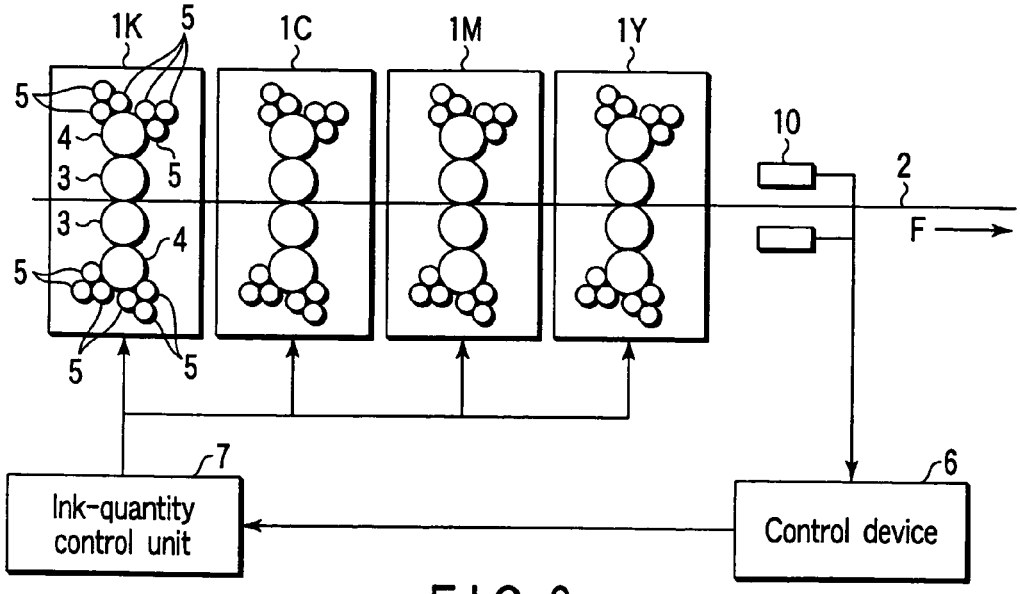
FIG. 2 is a block diagram showing the outline of the printing control device according to the first embodiment.

FIG. 2 is a block diagram showing the outline of the printing control device according to this embodiment.

Printing units 1K, 1C, 1M, and 1Y are respectively arranged along the carrying direction F of a printing sheet 2, and print four colors of K, C, M, and Y which are basic color of printing on the printing sheet 2, respectively.

The printing unit 1K comprises a blanket cylinder 3, a plate cylinder 4 and ink rollers 5. The other printing units 1C, 1M, and 1Y have the same configuration as the printing unit 1K, but reference symbols are omitted in the above FIG. 2.

The printing units 1K, 1C, 1M, and 1Y respectively comprise several ink keys arranged in the direction orthogonal to the carrying direction F of the printing sheet 2. The printing units 1K, 1C, 1M, and 1Y respectively change color densities of K, C, M, and Y by opening or closing the ink keys.

The ink keys provided for each of the printing units 1K, 1C, 1M, and 1Y are opened or closed by an ink-amount control unit 7 to be operated in accordance with an ink-key control signal supplied from a control device 6.

Operator-handling stations 8*a* and 8*b* are used to input an operation to the control device 6 from a printing operator and output control information supplied from the control device 6.

Figure 3:
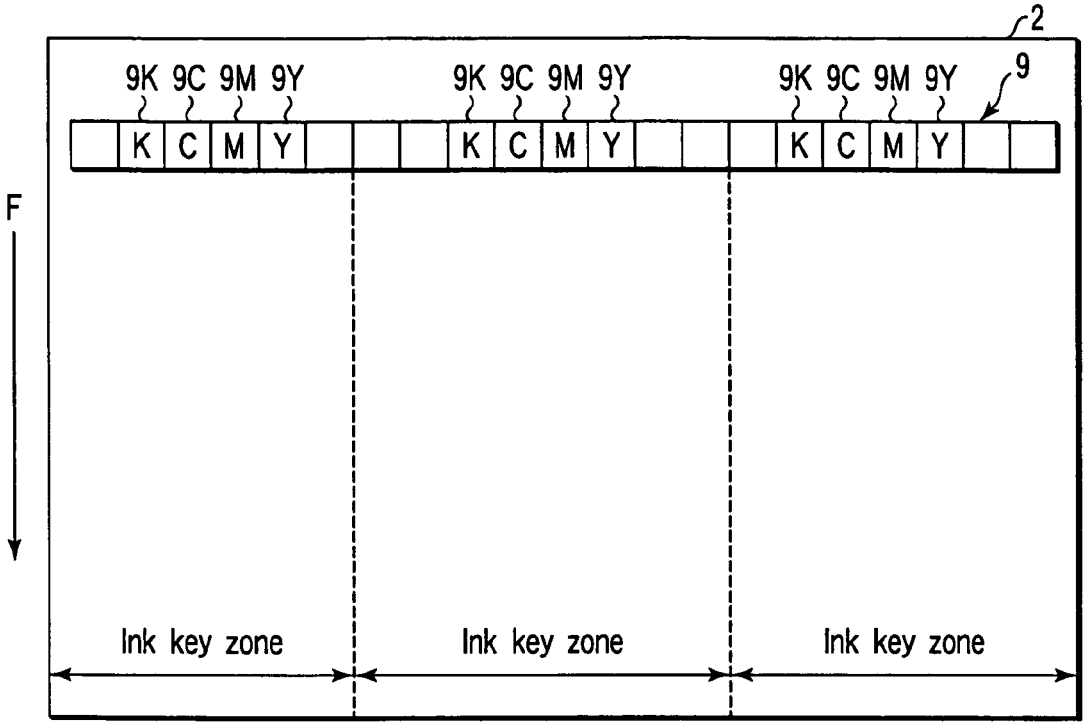
FIG. 3 is an illustration showing an example of a printed sheet according to the first embodiment.

FIG. 3 is an illustration showing an example of a printed sheet according to this embodiment. A control strip 9 including several patches arranged in the direction orthogonal to the carrying direction F, that is, the direction in which ink keys are arranged is printed on the printing sheet 2.

The control strip 9 includes typical patches 9K, 9C, 9M, and 9Y at halftone-dot area rates of 60 to 85% in the width of each ink key (ink-key zone).

The printing control device of this embodiment comprises a measuring device 10 and the control device 6 shown in FIGS. 1 and 2.

The measuring device 10 measures color densities of patches included in the control strip 9 printed on the printing sheet 2 by the printing units 1K, 1C, 1M, and 1Y. The measuring device 10 uses, for example, a CCD camera. The measuring device 10 is set to a stand 11.

The control device 6 performs the control for keeping color densities of the four typical patches 9K, 9C, 9M, and 9Y in each predetermined color-density range in the width of each ink key and outputs an ink-key control signal to the ink-amount control unit 7 in accordance with the result of the control.

The control device 6 executes the comparison determination processing for managing colors and the processing for outputting an ink-key control signal. However, it is also allowed to execute the above processings by another computer. When executing the processings by one control device like the case of this embodiment, A combination operation between processings is efficiently performed.

It is also allowed to set an alarm device (not shown) to the printing control device. Specifically, a buzzer or a lamp serves as the alarm device.

Figure 4:
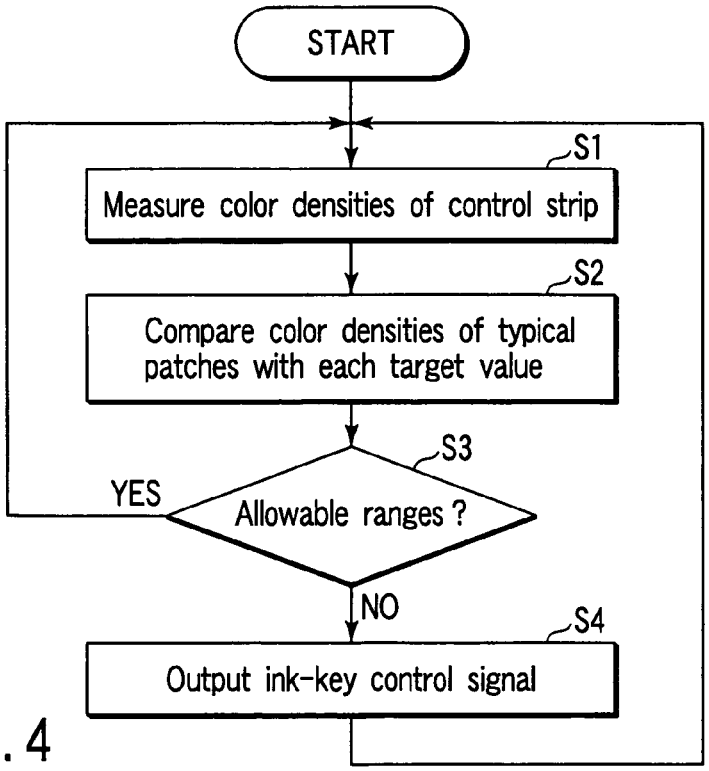
FIG. 4 is a flowchart showing an example of printing method according to the first embodiment.

FIG. 4 is a flowchart showing an example of a printing method according to this embodiment.

In step S1, the measuring device 10 measures the color densities of the control strip 9.

In step S2, the control device 6 compares the measured color densities of the four typical patches 9K, 9C, 9M, and 9Y with target values previously set to K, C, M, and Y in the width of each ink key.

In step S3, the control device 6 determines whether or not differences between the color densities of the four typical patches 9K, 9C, 9M, and 9Y and their target values is kept in allowable ranges.

When differences are kept in the allowable ranges, processings from step S1 downward are repeated.

When differences are not kept in the allowable ranges, the control device 6 outputs an ink-key control signal for opening or closing ink keys by a necessary value to the ink-amount control unit 7.

The printing method of this embodiment is described below in detail.

In the printing method according to this embodiment, the control strip 9 for measuring quality is printed at an optional position of the printing sheet 2. The control strip 9 is measured by the measuring device 10. The control device 6 inspects or manages the quality of the printing sheet 2 in accordance with a measurement result by the measuring device 10. The position at which the control strip 9 is printed is a part of a magazine or book to be cut in a book binding process when the magazine or book is finished with the printing sheet 2 or a blank space of the magazine or book free from images.

The control strip 9 includes the typical patches 9K, 9C, 9M, and 9Y for inspecting ink amount of colors of K, C, M, and Y or managing the quality.

The typical patches 9K, 9C, 9M, and 9Y are single color screen-tint patches in which dot area rates of K, C, M, and Y range between 60 and 85%.

It is also allowed to set the dot area rate of the typical patch 9K to 100% instead of the range between 60 and 85%.

When the range of the dot area rate of 60 to 85% is kept in a range of 75 to 85%, it is possible to improve the quality of printing more.

Advantages when setting dot area rates of the typical patches 9K, 9C, 9M, and 9Y in a range of 75 to 85% are described below.

In a general ink-amount adjusting method, when the fluctuation value of the measurement data for example color densities or color information exceeds a certain threshold value, the ink amount of a printing unit is adjusted.

To accurately adjust an ink amount, it is necessary to decide a proper threshold value at which a printing color density is stabilized and accurately measure data.

It is also allowed that the control strip 9 includes other types of auxiliary patches in addition to the typical patches 9K, 9C, 9M, and 9Y in the width of each ink key.

By measuring other types of patches and thereby performing control, auxiliary advantages such as improvement of accuracy, improvement of efficiency, and obtainment of other information are obtained.

When the printing space of the control strip 9 is small, the number of other types of patches is decreased and the typical patches 9K, 9C, 9M, and 9Y are preferentially included in the control strip 9. Thereby, it is possible to correspond to the small printing space of the control strip 9.

A case of controlling printing by using color densities as measurement data is described below.

In the case of general offset printing, the optical reflection color density of a screen tint at a dot area rate of 75% is approx. 0.8 and the optical reflection color density of a screen tint at a halftone-dot area rate of 85% is approx. 1.0. Moreover, the optical reflection color density of a solid portion is approx. 1.4.

The fluctuation permissible range of the solid color density recommended for offset printing is ±0.14. However, when considering the quality requested by users, it is preferable that the fluctuation permissible range of the solid color density is managed at approx. ±0.10.

When the solid color density fluctuates at the full measure of the above fluctuation range, the fluctuation range of the screen-tint color density at a dot area rate of 75% becomes approx. ±0.05 and the fluctuation range of the screen-tint color density at a dot area rate of 85% becomes approx. ±0.07.

Moreover, the color density of a printed matter fluctuates in a certain range due to a slight change of surrounding environments. This fluctuation is referred to as natural fluctuation.

For example, a color density repeats fluctuation in a certain range due to natural fluctuation. In this case, control is performed such that the median of the fluctuating color density becomes the target value of the color density.

When a threshold value is small and an ink amount is frequently adjusted, the fluctuation of the color density of a printed matter increases. Therefore, to prevent frequent ink-amount adjustment, a value of a natural fluctuation value+$\alpha$ is set as the threshold value for ink-amount adjustment.

Considering the threshold value of the natural fluctuation value+$\alpha$ and moreover, the measurement error of a color density, it is preferable to set a threshold value for control to ±0.05 or more in terms of solid color density in the case of normal offset printing.

In the case of the color density of a screen tint at a dot area rate of 75% or the color density of a screen tint at a dot area rate of 85%, it is preferable to set the threshold value for control to approx. ±0.02 or ±0.03 or more.

Thus, a relation between fluctuation permissible range and threshold value of a color density is determined as described below.

In the case of a solid color density, a fluctuation permissible range is kept at ±0.10, a threshold value is kept at ±0.05 or more, and a threshold-value adjustable range is kept at 0.03 for either side.

In the case of a screen-tint color density of 75%, a fluctuation permissible range is kept at ±0.05, a threshold value is kept at ±0.02 or more, and a threshold-value adjustable range is kept at 0.01 for either side.

In the case of a screen-tint color density of 85%, a fluctuation permissible range is kept at ±0.07, a threshold value is kept at ±0.03 or more, and a threshold-value adjustable range is kept at 0.02 for either side.

A threshold-value adjustable range denotes a threshold value for outputting an ink-key control signal for controlling an ink amount in order to keep the fluctuation of the color density of a printing sheet in a permissible range. The threshold-value adjustable range is set to a value of −0.02 of a fluctuation permissible range by considering the fluctuation of a color density until a control result is reflected on a printed matter.

There are various color-density measuring methods. To measure a certain point on a printing sheet moving at a high speed, it is preferable to use a method allowing the image processing for absorbing a shift of the printing sheet. As a prospective method, there is the measurement using a camera using a CCD or a line sensor.

When using a CCD, the significant digit in terms of a color density is two places of decimals because of the characteristic of the CCD.

Moreover, when using a high-sensitivity sensor such as a photomultiplier to measure a part at a small quantity of light, the significant digit in terms of a color density can be raised up to three places of decimals in accuracy. However, when using a photo-multiplier, it is impossible to perform the image processing for absorbing a shift of a printing sheet.

Therefore, in the case of the measurement of a color density on a printing sheet moving at a high speed, the accuracy may be deteriorated and a significant digit may become one place of decimals.

From the viewpoints of a threshold value for control and a measurement error of a color density, the color density of a screen tint at a dot area rate of 75% is defined as a proper value as the lower limit of a color density used for the color density to control an ink amount.

Then, a dot area rate is described below from the viewpoint of control effect.

As described above, because the quality from the middle part up to the light part cannot be assured only by management of a solid part, it is effective to control an ink amount by using the color density or color information of a screen tint at a dot area rate of 60 to 85% in order to manage both the middle part and the solid part so as to be well-balanced.

As the dot area rate used to manage the printing quality decreases, the middle part comes nearer. Therefore, the quality of the light part of a printed matter is stabilized from the middle part of it compared to the case of the solid part of it.

However, as the dot area rate used to manage the printing quality increases, the dot area rate comes near to a dot area rate of the solid part. Therefore, the fluctuation of the light part of the printed material increases from the middle part thereof. Accordingly, though it is better that the dot area rate is higher from the viewpoint of control, it is not preferable that the dot area rate exceeds 85%.

Therefore, it is preferable to perform control by using the measurement data such as the color density or color information of a screen tint with a dot area rate of 75 to 85% from the viewpoints of a threshold value of control, a measurement error a color density, and control effect.

In the case of offset printing, because an ink amount is adjusted in accordance with the opening degree of blades divided along the carrying direction of a printing sheet, it is impossible to obtain the information on a pattern from patches not corresponding to the pattern in the carrying direction of the printing sheet.

Thus, it is necessary to arrange a part for inspecting ink amount of four colors of K, C, M, and Y which are at least basic colors for printing.

In this embodiment, the quality of an images is determined by the single color typical patches 9K, 9C, 9M, and 9Y of K, C, M, and Y with a dot area rate of 60 to 85% included in the control strip 9 in the width of each ink key.

The information in which an ink amount and a dot gain are combined is obtained from the information obtained from the typical patches 9K, 9C, 9M, and 9Y.

When performing control by using the typical patches 9K, 9C, 9M, and 9Y, an inspection accuracy is obtained which is superior to the case of performing control by using patches whose dot area rates are not included in a range of 60 to 85%.

By performing control in accordance with the typical patches 9K, 9C, 9M, and 9Y in the width of each ink key, a printed matter well-balanced from the middle part up to shadow part on each color is printed in the width of each ink key.

In the case of this embodiment, it is also allowed to determine the quality of an image in the width of each ink key in accordance with the information obtained from the typical patches 9K, 9C, 9M, and 9Y by setting a dot area rate of the typical patch of K to 100% and dot area rates of other typical patches of C, M, and Y in a range of 60 to 85%.

The information obtained from the typical patches 9K, 9C, 9M, and 9Y when setting the dot area rate of the typical patch 9K to 100% includes information on the ink amount of the typical patch 9K and information in which ink amount of the typical patches 9C, 9M, and 9Y are combined with dot gains. By setting the dot area rate of the typical patch 9K to 100% and the dot area rates of other typical patches 9C, 9M, and 9Y in a range of 60 to 85% and performing control in the width of each ink key, it is possible to stabilize the ink amount for K and keep the color density of, for example, characters constant. Moreover, it is possible to perform well-balanced printing from the middle part up to shadow part on colors of C, M, and Y.

It is necessary to properly use whether to set the dot area rate of the typical patch 9K of K in a range of 60 to 85% or to 100% depending on the number of characters or the color of an image to be printed.

For example, in the case of an image including many characters, it is necessary to set the dot area rate of the typical patch 9K to 100% and control a color density because K is frequently used for solid.

On the other hand, in the case of an image which places emphasis on an ink amount and information corresponding to a dot gain, it is necessary to control a color density by setting the dot area rate of the typical patch 9K in a range of 60 to 85%.

In this embodiment described above, it is possible to obtain a high-quality printed matter reproduced in a state close to a color sample compared to a printed matter controlled by considering only ink amount of K, C, M, and Y.

Moreover, in this embodiment, even a young unskilled printing operator can perform printing at the same quality as the level of an experienced printing operator.

In this embodiment, by measuring the control strip 9 with the measuring device 10, the accuracy for inspecting or managing the quality of the printing sheet 2 is improved and the efficiency of processing or operation is improved.

Particularly, even by reducing the number of patches included in the control strip 9, the accuracy for inspecting or managing the printing quality is improved and the efficiency is improved.

The width of one ink key of a printing unit is approx. 30 to 40 mm. However, the number of patches to be printed in the width of one ink key is not restricted but it is possible to freely change the number of patches.

In this embodiment, it is possible to set the number of patches arranged along the line of ink keys in the range on a printing sheet corresponding to the width of one ink key to approx. 14 when the width of one ink key is approx. 30 to 40 mm.

However, the number of patches to be printed in the width of one ink key is not restricted to approx. 14 but it is possible to freely change the number of patches.

In this embodiment, several patches are arranged in line in the direction orthogonal to the carrying direction F of the printing sheet 2. However, when an area necessary for measurement is secured, it is allowed to optionally change arrangement patterns of patches.

EXAMPLE 1

Example 1 of the first embodiment will be described below.

Figure 5:
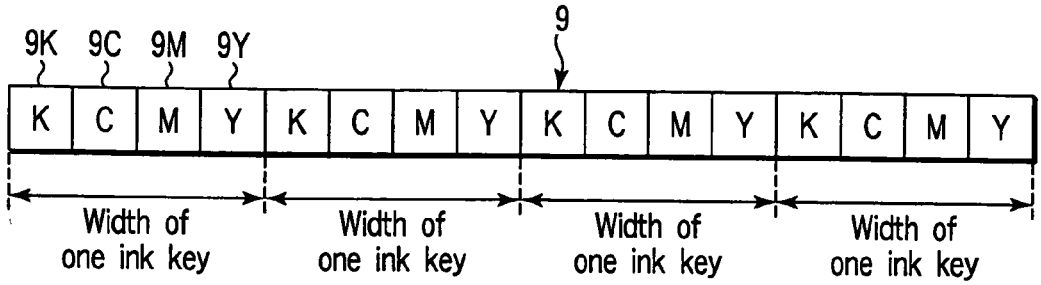
FIG. 5 is an illustration showing a control strip used in Example 1 according to the first embodiment.

FIG. 5 is an illustration showing the control strip 9 used in Example 1 of this embodiment.

In Example 1, it is assumed that ink keys of printing units 1K, 1C, 1M, and 1Y are arranged along the line of patches. In the case of the example 1, four typical patches 9K, 9C, 9M, and 9Y of K, C, M, and Y form a region corresponding to one ink key.

When printing, the printing sheet 2 is carried in the direction orthogonal to the line of the typical patches 9K, 9C, 9M, and 9Y.

The arrangement sequence of colors K, C, M, and Y is optional. When arranging only four 9K, 9C, 9M, and 9Y in the width of each ink key like this example 1, it is more preferable to arrange the typical patches 9C and 9M greatly influencing the view of an image at the middle of the width of each ink key from the viewpoint of the quality control of printing.

When arranging types of patches different from the four typical patches 9K, 9C, 9M, and 9Y in the repetitive unit of the width of one ink key of several patches included in the control strip 9, it is preferable to arrange the four typical patches 9K, 9C, 9M, and 9Y nearby the center of the repetitive unit from the viewpoint of reducing the influence of ink or the like in the peripheral region.

Example 1 adopts the offset printing as a printing system. Therefore, patches of four colors are placed in each ink blade and adjusted the sizes of them in order to obtain the information on each color.

Images were selected which frequently appeared in a general magazine such as a natural picture including a woman, cosmetics, sky, and a forest.

First, printing was performed in accordance with the information on solid patches for inspecting ink amount of four colors.

After the ink amount were kept in their allowable ranges, 20 continuous printed sheets were sampled.

Five printed sheets were selected from the 20 printed sheets to measure color differences (CIELAB) from a proof sheet serving as a color sample by a spectrophotometer.

As a result of averaging color differences between selected printed sheets and color samples, an average value of 2.9 was obtained. There was a part in which a color difference exceeded 5, depending on a color.

In general, a color difference of 6 or less is preferable in printing and a color difference of 3 or less is preferable in the case of a high-class printed matter.

Then, the present plate was changed to a plate for printing the control strip 9 including typical patches 9K, 9C, 9M, and 9Y at a dot area rate of 80% to perform the same test.

After the value of each color was kept in its allowable range, 20 continuous printing sheets were sampled.

Five printing sheets were selected from the 20 sheets to measure color differences from a proof sheet serving as a color sample.

As a result of averaging color differences between selected printed sheets and color samples, an average value was 2.4. The maximum value of color difference was 3.8.

EXAMPLE 2

Example 2 of the first embodiment will be described below.

Figure 6:
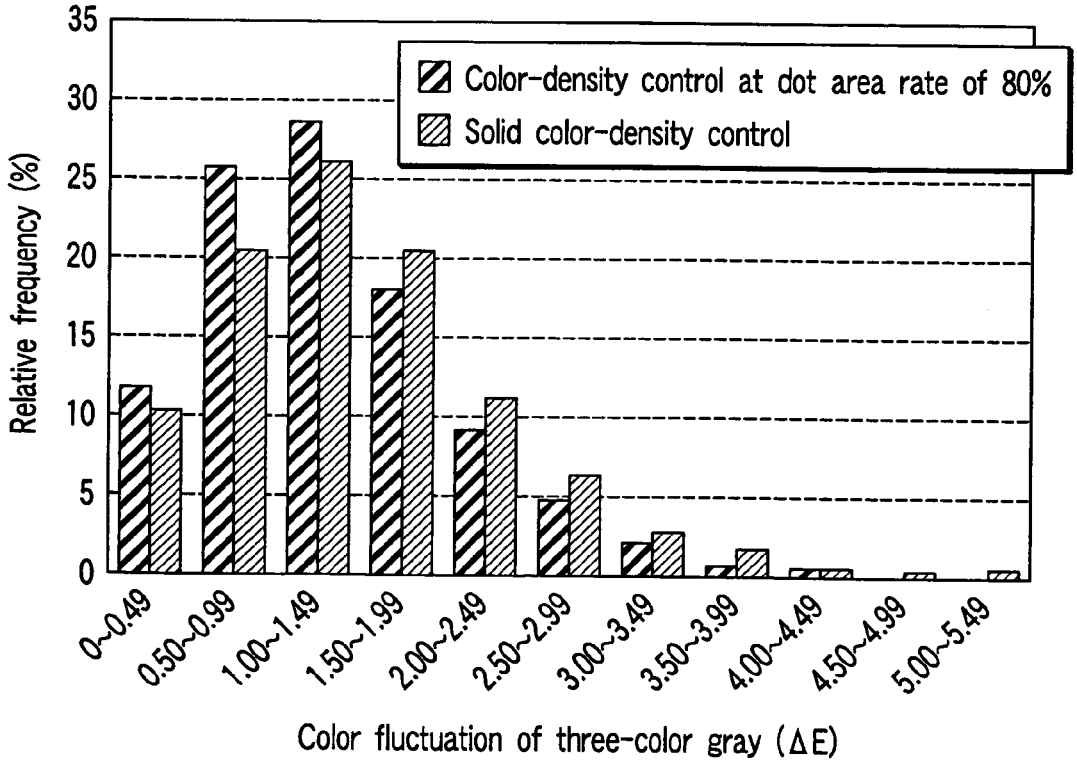
FIG. 6 is an illustration showing a relations between color differences and relative frequencies when controlling ink keys by typical patches at a dot area rate of 80% and controlling ink keys by solid patches in Example 2 according to the first embodiment.

FIG. 6 shows relations between color differences and relative frequencies from controlling ink keys with the typical patches 9K, 9C, 9M, and 9Y at a dot area rate of 80% and from controlling ink keys with four solid patches, when the typical patches 9K, 9C, 9M, and Y at a dot area rate of 80% and four solid patches are include in the control strip 9.

Table 1 shows average color differences and the relative cumulative frequency % for each color difference in FIG. 6.

TABLE 1

| | Number of printing units | Total number | Average color difference | Relative cumulative frequency % | | | |
|---|---|---|---|---|---|---|---|
| | | | | Color difference of 1 or less | Color difference of 2 or less | Color difference of 3 or less | Color difference of 4 or less |
| 80% color density control | 4 | 4221 | 1.31 | 37.2 | 83.7 | 97.0 | 99.4 |
| Solid color density control | 4 | 3355 | 1.47 | 30.8 | 77.5 | 94.6 | 98.8 |

From results in FIG. 6, it is found that the frequency at the part of small color differences from the color density control at a dot area rate of 80% is larger than the case of the solid color density control.

Moreover, in Table 1, superior results are obtained in average color differences and the relative cumulative frequency % for each color difference from the color density control at a dot area rate of 80% compared to the case of the solid color-density control.

(Second Embodiment)

A printing trouble such as doubling or slur is caused by a shift of a printing sheet while it is printed. There is also a printing trouble caused when ink and water are unbalanced.

For this second embodiment, a printing method of finding the above printing troubles early, a printed matter for use in the printing method, and a printing control device are described.

The configuration of the printing control device shown in FIGS. 1 and 2 can be used as the configuration of the printing control device of this embodiment.

However, the processing to be executed by the control device is different from the case of the control device 6 in FIGS. 1 and 2.

Figure 7:
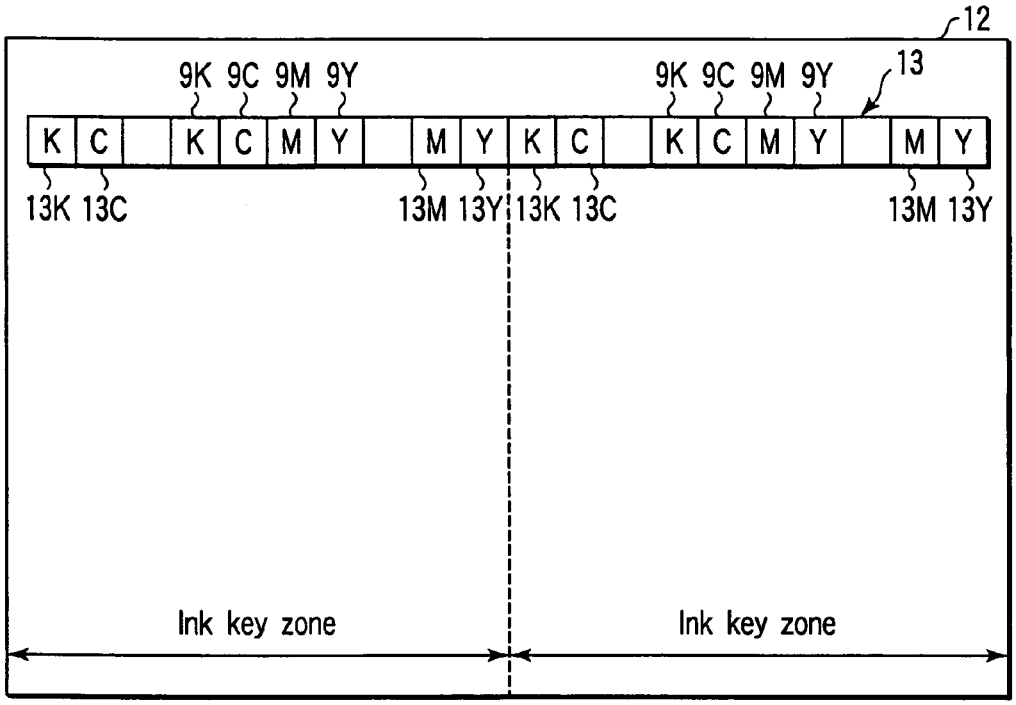
FIG. 7 is an illustration showing an example of a printed sheet according to a second embodiment of the present invention.

FIG. 7 is an illustration showing an example of a printed sheet according to this embodiment.

A relation between a printed sheet 12 and a control strip 13 is the same as the relation between the printed sheet 2 and the control strip 9 in FIG. 3.

The control strip 13 includes typical patches 9K, 9C, 9M, and 9Y at dot area rates of 60 to 85% in the width of each ink key.

Moreover, the control strip 13 includes solid patches 13K, 13C, 13M, and 13Y at a dot area rate of 100% on K, C, M, and Y in the width of each ink key.

Figure 8:
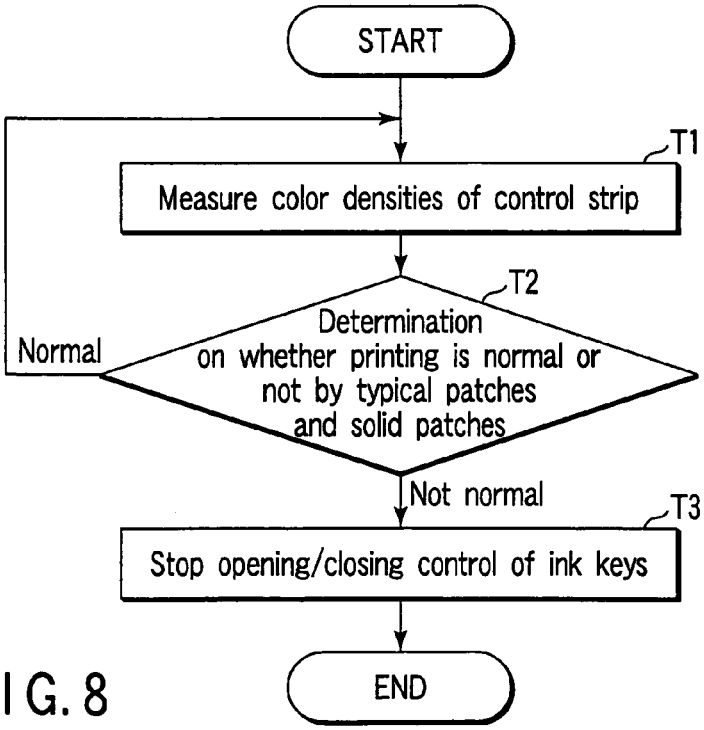
FIG. 8 is a flowchart showing an example of a printing method according to the second embodiment.

FIG. 8 is a flowchart showing an example of a printing method according to this embodiment.

In step T1, the measuring device measures the color densities of the control strip 13.

In step T2, the control device determines whether or not the printing is normal in accordance with four measured color densities of the typical patches 9K, 9C, 9M, and 9Y and four measured color densities of the solid patches 13K, 13C, 13M, and 13Y in the width of each ink key.

For example, the control device obtains ratios between the color densities of the four typical patches 9K, 9C, 9M, and 9Y and the color densities of the four typical solid patches 13K, 13C, 13M, and 13Y in the width of each ink key and determines whether or not the ratios are normal in accordance with whether or not the ratios are included in a preset range in the width of each ink key.

Also, for example, the control device obtains differences between the color densities of the four typical patches 9K, 9C, 9M, and 9Y and the color densities of the four solid patches 13K, 13C, 13M, and 13Y in the width of each ink key and determines whether or not the differences are normal in accordance with whether or not the differences are included in a preset range.

When it is determined that the differences are normal, steps from the above step T1 downward are repeated.

However, when it is not determined that the differences are normal, the control device outputs an alarm and stops opening or closing ink keys of printing units in step T3.

The printing method of this embodiment is described below in detail.

In the printing method of this embodiment, ratios or differences between the color densities of the solid patches 13K, 13C, 13M, and 13Y and the color densities of the typical patches 9K, 9C, 9M, and 9Y are obtained on colors of K, C, M, and Y in the width of each ink key and it is determined whether or not the ratios or differences are included in a predetermined range. In the printing method of this embodiment, a doubling or slur under printing or sudden unbalance between ink and water is detected in accordance with the above determination result.

When controlling the opening degree of ink keys in accordance with the color densities of the solid patches 13K, 13C, 13M, and 13Y without detecting the above printing trouble when it occurs, doubling, slur or sudden conditional change is not detected and printing may be continued with the printing trouble.

Moreover, when controlling the opening degree of ink keys in accordance with only color densities of the typical patches 9K, 9C, 9M, and 9Y, the color density of a measurement part is fluctuated due to doubling, slur, or sudden conditional change and a color density different from the normal color density may appear.

When controlling the opening degree of ink keys without finding the cause of a printing trouble, the color tone of the whole image may become inferior.

For example, when doubling or slur occurs, a color density normally rises. Therefore, ink is controlled so that an ink amount decreases. As a result, a color density lowers at a solid part, a part where doubling or slur does not occur, or a part which is not greatly influenced by doubling or slur.

When controlling the opening degree of ink keys by a solid color density, a printed matter may not be kept at the quality level as a commercial product even if it looks like a normal printed matter because the above printing trouble occurs.

In this case, it takes a lot of time to find a printed sheet printed while a printing trouble occurs and eliminate them. In addition, a printed matter may be delivered to a user without becoming aware of a printing trouble.

The following describes the reason why color densities of the solid patches 13K, 13C, 13M, and 13Y and the color densities of the typical patches 9K, 9C, 9M, and 9Y are used to determine a printing trouble.

The reason why the solid patches 13K, 13C, 13M and 13Y were used is that the solid patches are suitable for a color density as a comparison object since change in color density is little even if a printing trouble occurs.

On the other hand, the reason why the typical patches 9K, 9C, 9M and 9Y were used is that, in a screen tint patch at a dot area rate of less than 60%, the fluctuation width of a color density due to a printing trouble is small, and the sensitivity is deteriorated.

Ratios between the color densities of the solid patches 13K, 13C, 13M, and 13Y of K, C, M, and Y and the color densities of the typical patches 9K, 9C, 9M, and 9Y depend on printing conditions such as a paper, printing ink, printing speed, and screen resolution.

However, when these conditions are stabilized, for example, a printing press is well maintained and inks are properly managed, it is possible to obtain several target values (typical values) of ratios between the color densities of the solid patches 13K, 13C, 13M, and 13Y and the color densities of the typical patches 9K, 9C, 9M, and 9Y in accordance with the characteristic of a paper if the screen resolution is constant in plate making.

It is possible to obtain allowable ranges based on the target values in the normal production.

For example, by using the measured color density of a printed sheet (OK sheet) serving as a sample and thereby preparing a histogram as a analysis object and confirming that the distribution state of the histogram is normal, the average allowable range is estimated in accordance with the histogram.

A set target value and allowable range are previously input to a control device. As a result, the control device can detect the influence of the above doubling or slur, or a printing trouble such as the sudden unbalance between ink and water.

Moreover, when an printing operator confirms a printed sheet to decide a sample, the control device detects a printing trouble by using the ratios between the color densities of the solid patches 13K, 13C, 13M, and 13Y and the color densities of the typical patches 9K, 9C, 9M, and 9Y from the printed sheet as target values and using allowable ranges obtained in the normal production similarly to the above case.

When the control device determines that a printing trouble exceeds the allowable ranges, it outputs an alarm by assuming that the trouble occurs to communicate the printing trouble to the printing operator and stop controlling the opening degree of ink keys.

In this embodiment, the solid patches 13K, 13C, 13M, and 13Y and typical patches 9K, 9C, 9M, and 9Y are printed for colors of K, C, M, and Y for each zone corresponding to ink keys of printing press. Ink-key widths of printing press normally range between 30 and 40 mm and a sensor can measure the control strip 13 when one patch has a width of approx. 2.5 mm.

Therefore, in the case of a printing unit having an ink-key width of 35 mm, it is possible to arrange 14 patches in the width of each ink key. In this case, it is possible to print six more patches in addition to the total of 8 patches such as four single color solid patches 13K, 13C, 13M, and 13Y and four typical patches 9K, 9C, 9M, and 9Y. It is possible to optionally decide the six patches in accordance with a printed image and the management method of a printing plant.

Figure 9:
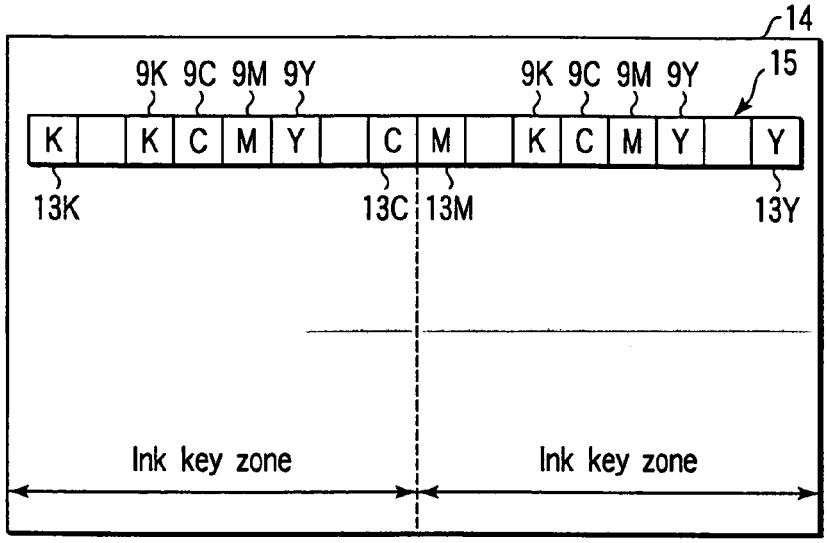
FIG. 9 is an illustration showing a modification of the printed sheet of the second embodiment.

FIG. 9 is an illustration showing a modification of the printed sheet of this embodiment.

Four solid patches 13K, 13C, 13M, and 13Y and four typical patches 9K, 9C, 9M, and 9Y are printed on the printed sheet 13 shown in FIG. 7.

However, it is also allowed to share the solid patches 13K, 13C, 13M, and 13Y at widths of several ink keys and dispersedly arrange the solid patches 13K, 13C, 13M, and 13Y to the ink-key widths like the case of the printed sheet 14 shown in FIG. 9. It is enough that at least one of the solid patches 13K, 13C, 13M, and 13Y for each color is included in several patches included in the control strip 15.

Thereby, it is possible to further decrease the number of patches necessary for control.

In this embodiment described above, it is possible to quickly detect a printing trouble such as doubling or slur or a printing trouble due to the abnormal balance between ink and water.

Moreover, in this embodiment, because control of an ink-key opening degree is stopped when a printing trouble occurs, it is possible to prevent a lot of printed matter with different color tones from being prepared, prevent unnecessary printing, and prevent a defective product from mixing in commercial products.

(Third Embodiment)

As described above, a printing trouble such as doubling or slur affects the printing quality. Moreover, ink and water are suddenly unbalanced and a conditional change exceeding an allowable range occurs, and thereby the printing quality may be deteriorated.

Furthermore, a printing trouble due to an unstable factor of a step of making a plate used for printing may occur because proper exposure or development is not performed in the step, the size of the halftone dot of a gray patch or screen tint patch is different from a set value, and as a result accurate information showing a printing state cannot be obtained.

In this embodiment, the following are described: a printing method of finding a printing trouble such as doubling or slur, printing trouble due to the abnormal balance between ink and water, or printing trouble due to an unstable factor of a plate making step, a printed matter used for the printing method, and a printing control device.

The configuration same as that of the printing control device shown in FIGS. 1 and 2 can be used as a configuration of the printing control device of this embodiment.

However, processings to be executed by a control device are different from processing of the control device 6 in FIGS. 1 and 2.

Figure 10:
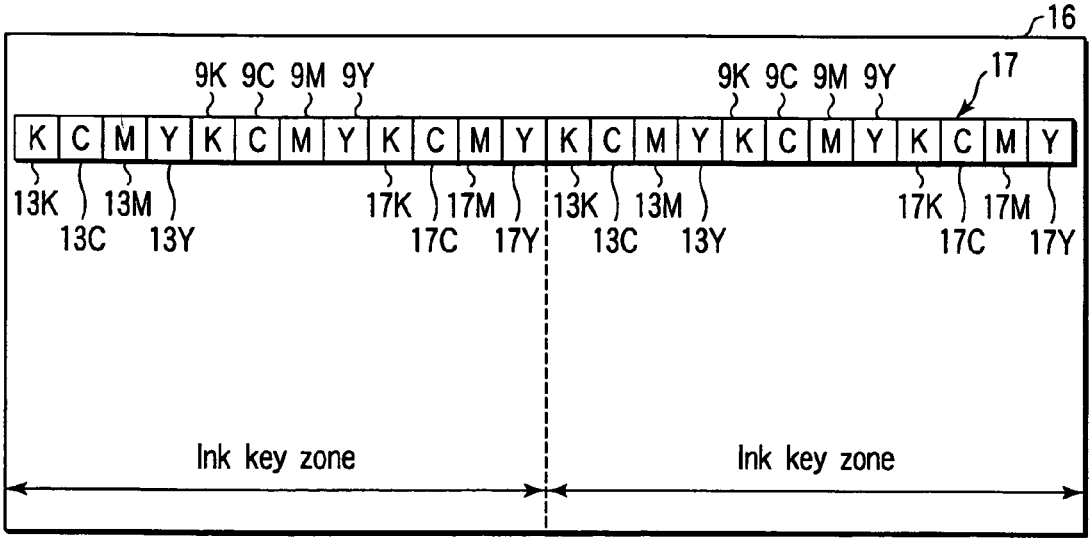
FIG. 10 is an illustration showing an example of a printed sheet according to a third embodiment of the present invention.

FIG. 10 is an illustration showing an example of a printed sheet according to this embodiment.

The relation between a printed sheet 16 and a control strip 17 is the same as the relation between the printed sheet 2 and the control strip 9 shown in FIG. 3.

The control strip 17 includes typical patches 9K, 9C, 9M, and 9Y at dot area rates of 60 to 85%, solid patches 13K, 13C, 13M, and 13Y, and middle patches 17K, 17C, 17M, and 17Y at dot area rates of 40 to 50% for K, C, M, and Y.

Figure 11:
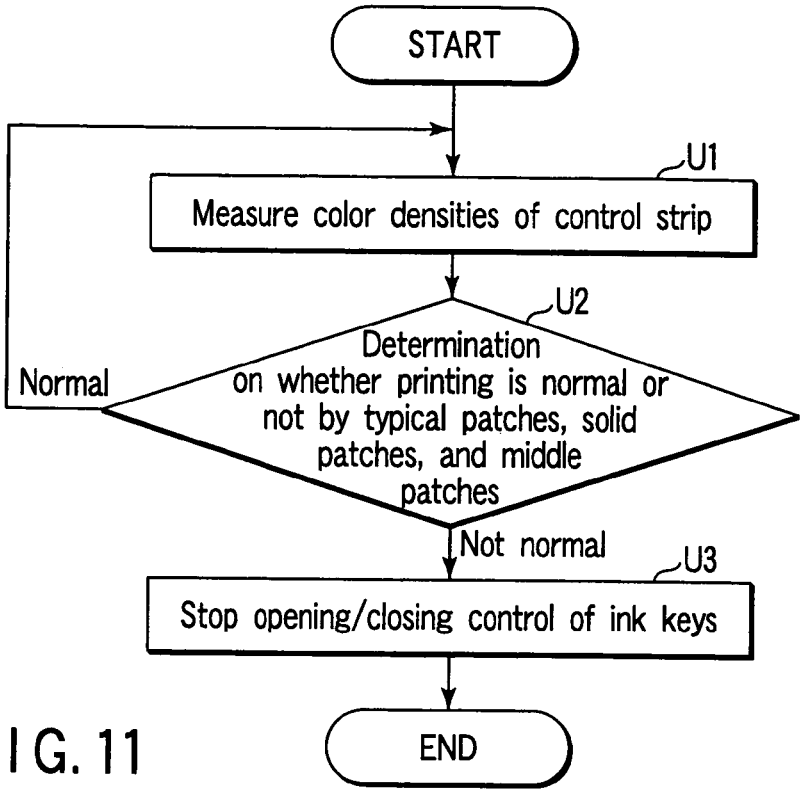
FIG. 11 is a flowchart showing an example of a printing method according to the third embodiment.

FIG. 11 is a flowchart showing an example of a printing method according to this embodiment.

In step U1, the measuring device measures the color densities of the control strip 17.

In step U2, the control device determines a normal state or not normal state in accordance with the measured color densities of four typical patches 9K, 9C, 9M, and 9Y, color densities of solid patches 13K, 13C, 13M, and 13Y, and color densities of middle patches 17K, 17C, 17M, and 17Y in the width of each ink key.

For example, the control device obtains the ratio or difference between the difference between a color density DD of a typical patch and a color density DL of a middle patch on one hand and the difference between a color density DS of a solid patch and the color density DD of a typical patch on the other hand on colors of K, C, M, and Y and determines a normal state or not normal state in accordance with whether or not the ratio or difference is included in a predetermined allowable range on each colors of K, C, M, and Y.

When the normal state is determined, processings from the processing in step U1 downward are repeated.

When the not normal state is determined, the control device outputs an alarm and stop opening or closing ink keys of printing units in step U3.

The printing method of this embodiment is described below in detail.

In the case of the printing method of this embodiment, the following color densities are firstly measured on colors of K, C, M, and Y in the width of each ink key: the color densities of the solid patches 13K, 13C, 13M, and 13Y, the color densities of the typical patches 9K, 9C, 9M, and 9Y, and the color densities of the middle patches 17K, 17C, 17M, and 17Y.

Secondly, the ratio or difference between the difference between the color density DD of a typical patch and the color density DL of a middle patch on one hand and the difference between the color density DS of a solid patch and the color density DD of a typical patch on the other hand is obtained on colors of K, C, M, and Y and it is determined whether or not the ratio or difference is included in a predetermined allowable range.

In the case of the printing method of this embodiment, the following are detected in accordance with the above determination result: doubling or slur in printing, change of a condition due to sudden unbalance between ink and water, and a printing trouble which occurs when conditions of a plate making step are unstable.

When the size of a dot of a patch to be controlled is different from a designed value due to instability of the exposure or development condition of the plate making step, a color density different from a normal value appears even if proper amount of ink is being supplied.

When the dot becomes large in accordance with the instability of the development condition, a color density normally rises. Therefore, an ink key is controlled such that an ink amount is decreased and a color density generally becomes lower than a proper value.

On the other hand, when the dot becomes small in accordance with the instability of the development condition, a color density normally comes down. Therefore, an ink key is controlled such that an ink amount is increased and a color density generally becomes higher than a proper value.

The reason why the color density DS of a solid patch, the color density DD of a typical patch, and the color density DL of a middle patch are used to determine a trouble of printing is described below.

The color density DS of a solid patch is used because it is suitable for a color density as a comparison object because a color-density change is small even if a printing trouble occurs.

The color density DD of a typical patch is used because in the case of a screen-tint patch at a dot area rate of less than 60%, the fluctuation width of a color density due to a printing trouble is small and the sensitivity as a control object is deteriorated.

The color density DL of a middle patch is used because in the case of a screen-tint patch at a dot area rate of less than 40%, the fluctuation width of a color density due to a printing trouble is small and the sensitive as a comparison object is deteriorated.

The ratio between the difference between the color density DD of a typical patch and the color density DL of a middle patch on one hand and the difference between the color density DS of a solid patch and the color density DD of a typical patch on the other hand depends on one of printing conditions such as a paper, printing ink, printing speed, and screen resolution.

However, when these conditions are stable, for example, when a printing press is well maintained and a printing ink is properly managed, it is possible to obtain several target values (typical values) on the ratio between the difference between the color density DD of the typical patch and the color density DL of the middle patch on one hand and the difference between the color density DS of the solid patch and the color density DD of the typical patch on the other hand in accordance with the characteristic of a printing sheet if the screen resolution for plate making is constant.

It is possible to obtain a allowable range based on the target values in the normal production.

For example, a histogram is prepared by using the measured color density of a printed sheet serving as a sample as an analysis object to confirmed that the distribution state of the histogram is normal and then, average allowable range is estimated in accordance with the histogram.

Set a target value and an allowable range are previously input to a control device. As a result, the control device can determine a printing trouble such as the influence of the above doubling or slur, change of conditions due to sudden unbalance between ink and water, or a trouble due to instability of a plate making step.

Moreover, when a printing operator confirms a printed sheet to decide a sample, the control device determines a printing trouble by using the ratio between the difference between the color density DD of a typical patch and the color density DS of a middle patch on one hand and the difference between the color density DS of a solid patch and the color density DD of a typical patch on the other hand in a printed sheet serving as a sample as a target value and thereby using an allowable range obtained in the normal production similarly to the above case.

When the control device determines that the printing trouble exceeds the allowable range, it outputs an alarm by assuming that a trouble occurs, communicates the printing trouble to the printing operator, and stops controlling the opening degree of ink keys.

In this embodiment, three type of patches such as the solid patches 13K, 13C, 13M, and 13Y, typical patches 9K, 9C, 9M, and 9Y, and middle patches 17K, 17C, 17M, and 17Y are printed by single color for each zone corresponding to an ink key of a printing press. The ink-key width of the printing press normally ranges between 30 and 40 mm and a sensor for measuring the control strip 17 can measure the strip 17 when one patch has a width of approx. 2.5 mm.

Therefore, in the case of a printing unit having an ink-key width of 35 mm, it is possible to arrange 14 patches in the width of each ink key. In this case, it is possible to print two more patches in addition to the total of 12 patches such as four single color solid patches 13K, 13C, 13M, and 13Y, four typical patches 9K, 9C, 9M, and 9Y, and four middle patches 17K, 17C, 17M, and 17Y. It is possible to optionally decide the two more patches in accordance with an object image or the management method of a printing plant.

Figure 12:
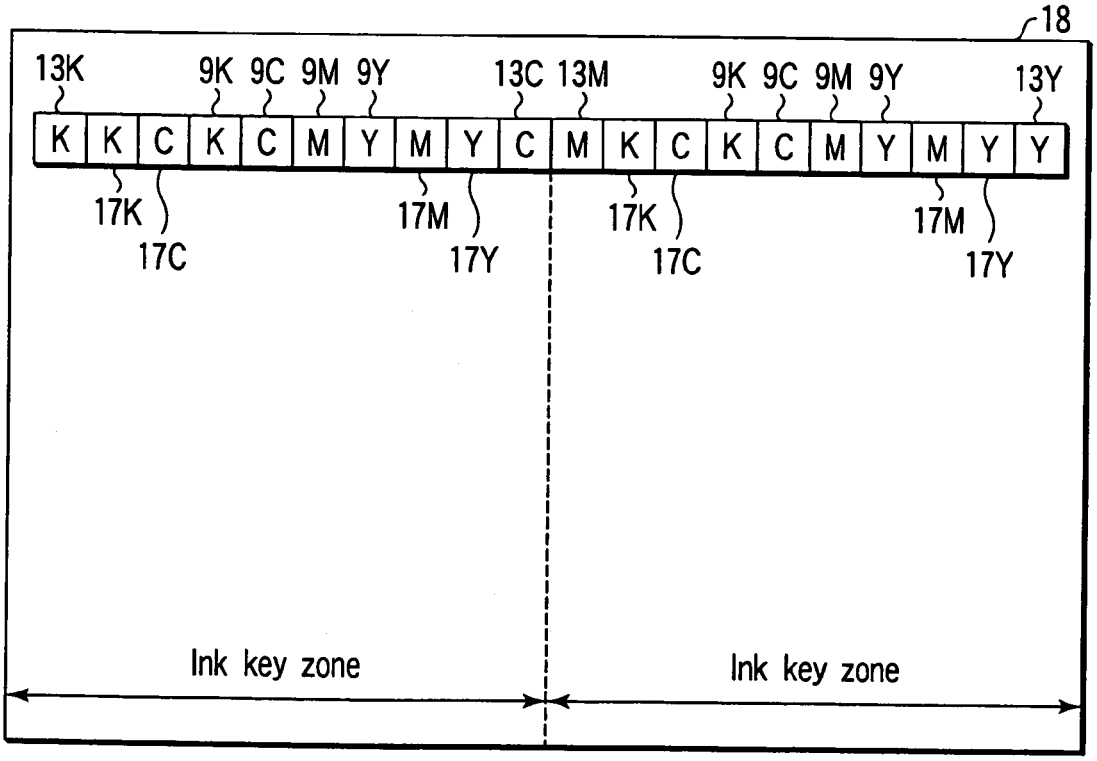
FIG. 12 is an illustration showing a modification of the printed sheet of the third embodiment.

FIG. 12 is an illustration showing a modification of a printed sheet according to this embodiment.

On a printed sheet 16 shown in FIG. 10, the four solid patches 13K, 13C, 13M and 13Y, four typical patches 9K, 9C, 9M and 9Y, and four middle patches 17K, 17C, 17M and 17Y are printed in the width of each ink key.

However, it is allowed to share the solid patches 13K, 13C, 13M, and 13Y at widths of several ink keys and dispersedly arrange the solid patches 13K, 13C, 13M, and 13Y to the ink-key widths like the case of a printed sheet 18 shown in FIG. 12.

It is also allowed to share the middle patches 17K, 17C, 17M, and 17Y at widths of several ink keys and dispersedly arrange the middle patches 17K, 17C, 17M, and 17Y to the ink-key widths.

Thereby, it is possible to further reduce the number of patches necessary for control.

In this embodiment described above, it is possible to quickly detect a printing trouble when a printing trouble such as doubling or slur, printing trouble due to unbalance between ink and water, or printing trouble due to instability of conditions in a plate making step occurs.

Moreover, in this embodiment, by stopping the control of the opening degree of ink keys when a printing trouble occurs, it is possible to prevent mass production of printed sheets different from each other in color tone and prevent a defective product from mixing in commercial products.

EXAMPLE 1

Example 1 of the above third embodiment is described below.

It is assumed that the color density of a solid patch is DS, that of a typical patch is DD, and that of a middle patch is DL on a certain printed sheet.

A control device performs operations by using the following expression 1.

$$P=(DD-DL)/(DS-DD) \quad \text{(Expression 1)}$$

$$T=P1/P0 \quad \text{(Expression 2)}$$

In this case, P0 denotes a value of P obtained by measuring a printed material sheet under normal printing condition and P1 denotes a value of P obtained by measuring a current printed sheet.

The above expressions 1 and 2 are shown as examples. It is allowed that the control device performs control by using another ratio between color density differences.

Figure 13:
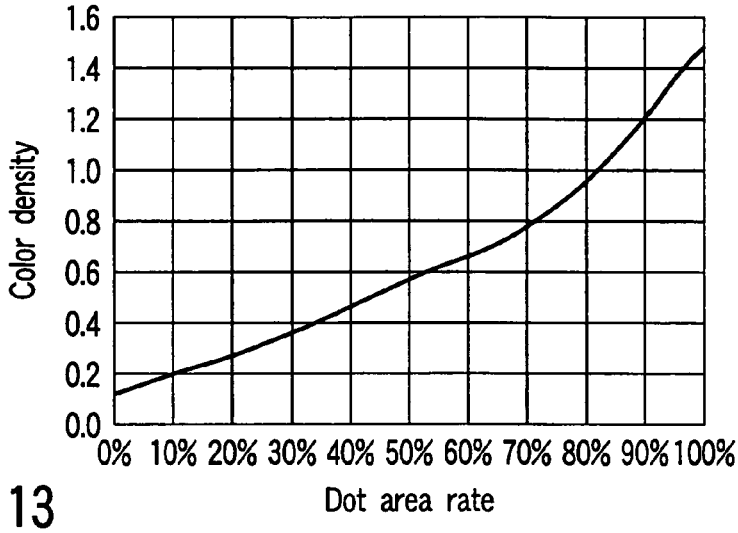
FIG. 13 is a graph showing a relation between dot area rates and color densities under the standard printing state.

FIG. 13 is a graph showing a relation between dot area rates and color densities under the standard printing state.

The axis of abscissa corresponds to the dot area rate and the axis of ordinate corresponds to the color density. The same is applied to other graphs.

As a result of computing T in accordance with the graph in FIG. 13, T shows 1 because P1 is equal to P0.

Figure 14:
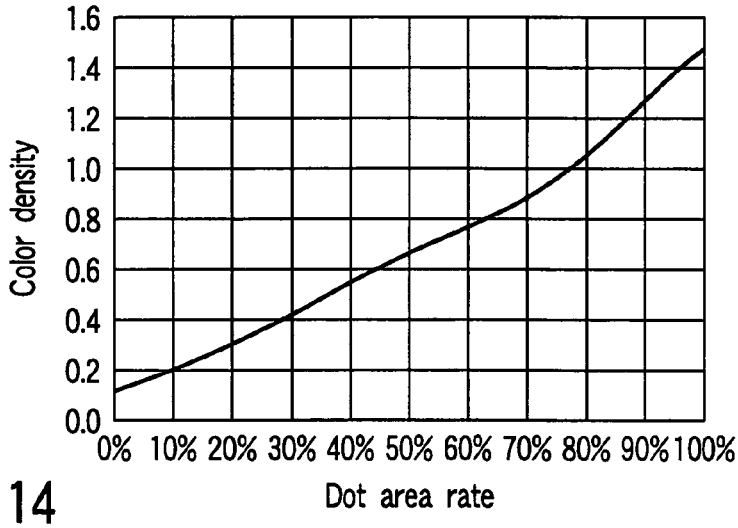
FIG. 14 is a graph showing a relation between dot area rates and color densities when an excessive dot gain occurs due to an ink-temperature rise during printing.

FIG. 14 is a graph showing relation between dot area rates and color densities when an excessive dot gain is generated due to an ink-temperature rise under printing.

As a result of computing T in accordance with the graph under the standard printing state in FIG. 13 and the graph in FIG. 14, T shows 1.205.

Figure 15:
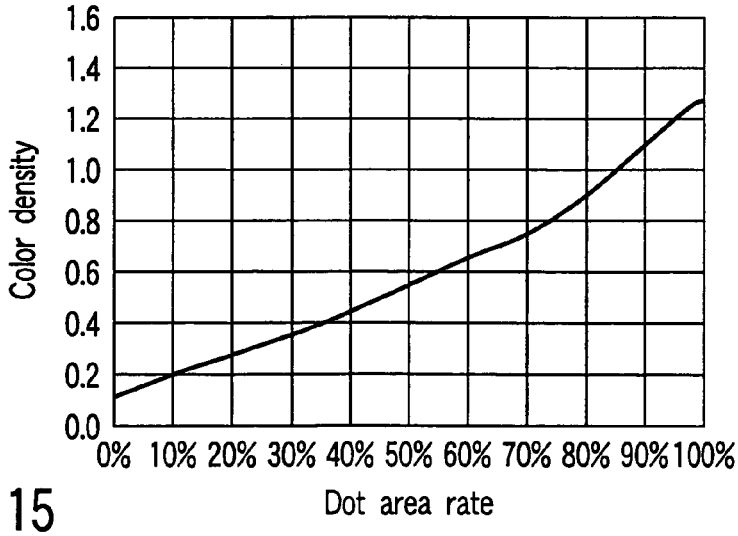
FIG. 15 is a graph showing a relation between dot area rates and color densities when an ink-transference trouble occurs because ink and dust are deposited on a blanket.

FIG. 15 is a graph showing a relation between dot area rates and color densities when ink and dust are deposited on a blanket and an ink transfer trouble occurs.

As a result of computing T in accordance with the graph under the standard printing state in FIG. 13 and the graph in FIG. 15, T shows 1.248.

Figure 16:
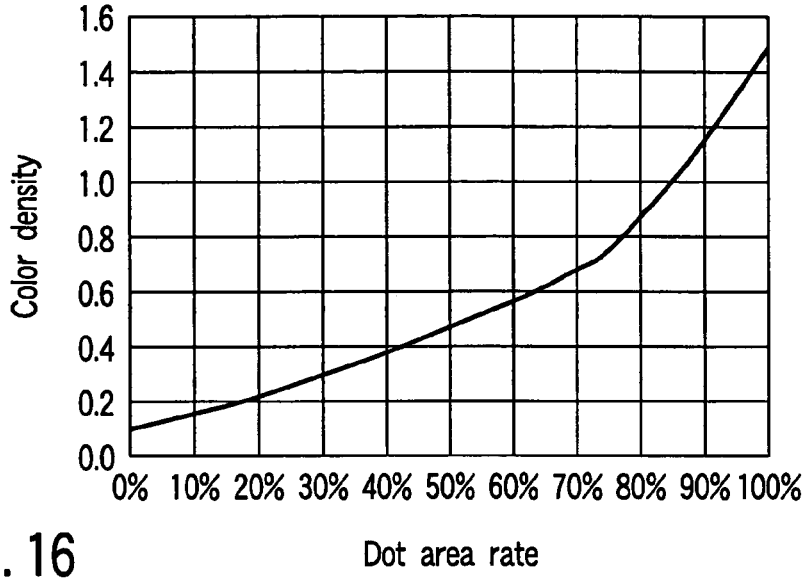
FIG. 16 is a graph showing a relation between dot area rates and color densities when ink becomes an excessively-emulsified state and thereby an intermediate color density does not rises even if the ink is sufficiently supplied.

FIG. 16 is a graph showing a relation between dot area rate and color densities when an intermediate color densities do not rise even by supplying much ink because the ink is excessively emulsified.

As a result of computing T in accordance with the graph under the standard printing state in FIG. 13 and the graph in FIG. 16, T shows 0.860.

From the above results, it is found that it is possible to determine whether or not a printing state is normal by using computing results of T.

Table 2 shows color densities of patches at dot area rates of 50%, 80%, and 100% when performing printing by using a printing plate obtained by changing exposure values when the plate is made.

TABLE 2

| | Exposure value of plate (reference: 100%) | | | | | | |
|---|---|---|---|---|---|---|---|
| | 30% | 50% | 70% | 100% | 150% | 170% | 200% |
| Dot area rate of 50% | 0.71 | 0.68 | 0.64 | 0.62 | 0.58 | 0.57 | 0.55 |
| Dot area rate of 80% | 1.11 | 1.07 | 1.04 | 1.02 | 0.97 | 0.96 | 0.94 |
| Dot area rate of 100% | 1.50 | 1.50 | 1.50 | 1.50 | 1.50 | 1.50 | 1.50 |

The same advantage is also obtained by using a middle patch at a dot area rate of 40 to 50% excluding 50% or a typical patch at a dot area rate of 60 to 85% excluding 80%.

As a result of a printed sheet to be printed by using a printing plate made at an exposure value 1.5 times larger than the normal value when it is made, sampling a printed sheet, and measuring the sampled printed sheet, and computing T, T shows 0.883.

Moreover, as a result of a printed sheet to be printed by using a printing plate made at an exposure value half of the normal value when it is made, sampling a printed sheet, measuring the sampled printed sheet, and computing T, T shows 1.088.

Furthermore, as a result of a printed sheet to be printed by using a printing plate made at an exposure value 30% smaller than the normal value, sampling a printed sheet, measuring the sampled printed sheet, and computing T, T shows 1.043.

By computing T and using the computation result in accordance with the above results, it is possible to determine whether or not a printing plate is normally made.

Moreover, by deciding a allowable range of T through the routine work, using the allowable range as a criterion, and thereby detecting a printing trouble, it is possible to prevent a printing trouble caused by performing the control for making the color densities of a control strip approach to a target value even if a printing state or printing plate is defective.

(Fourth Embodiment)

In this embodiment, a printing method of decreasing the time until a commercial printed matter is obtained after printing is started and keeping a preferable printing quality until printing is completed and a printing control device for use in the printing method are described.

The configuration same as that of the printing control device shown in FIGS. 1 and 2 can be used as a configuration of the printing control device of this embodiment.

However, processings to be executed by the control device are different from processings by the control device 6 in FIGS. 1 and 2.

Figure 17:
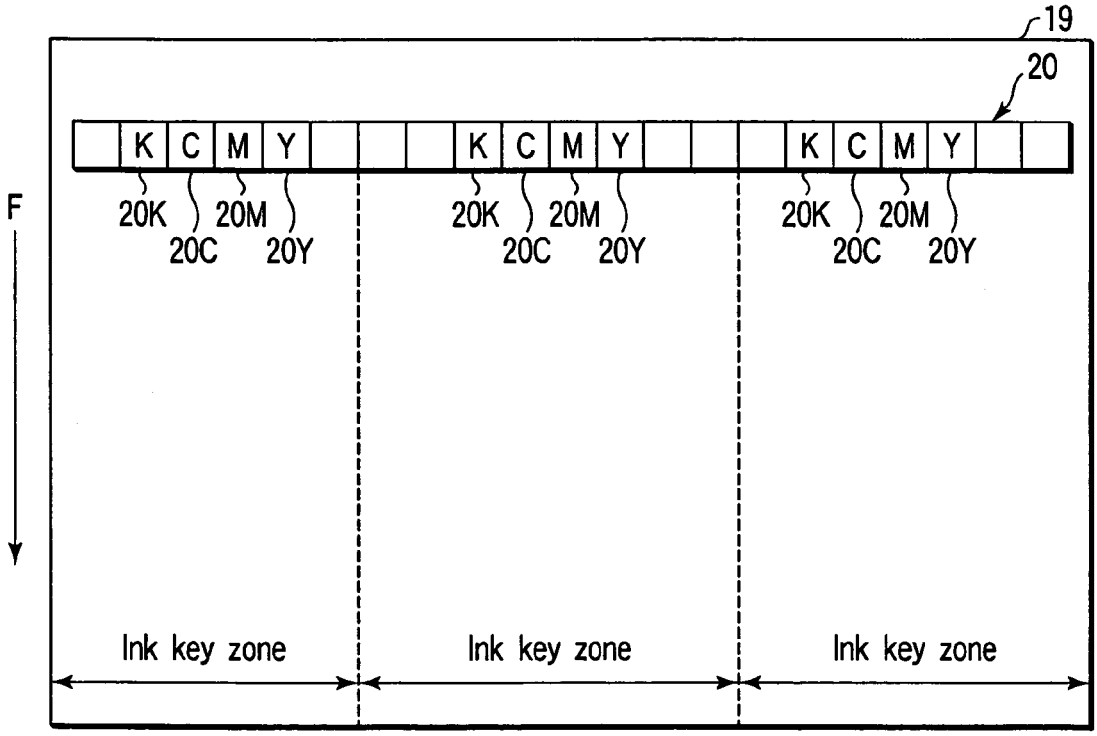
FIG. 17 is an illustration showing an example of a printed sheet according to a fourth embodiment of the present invention.

FIG. 17 is an illustration showing an example of a printed sheet according to this embodiment.

Patches 20K, 20C, 20M, and 20Y of four colors of K, C, M, and Y are included in a control strip 20 printed on a printed sheet 19 in the width of each ink key. It is allowed to use the patches 20K, 20C, 20M, and 20Y as the typical patches 9K, 9C, 9M, and 9Y or middle patches 17K, 17C, 17M, and 17Y.

Figure 18:
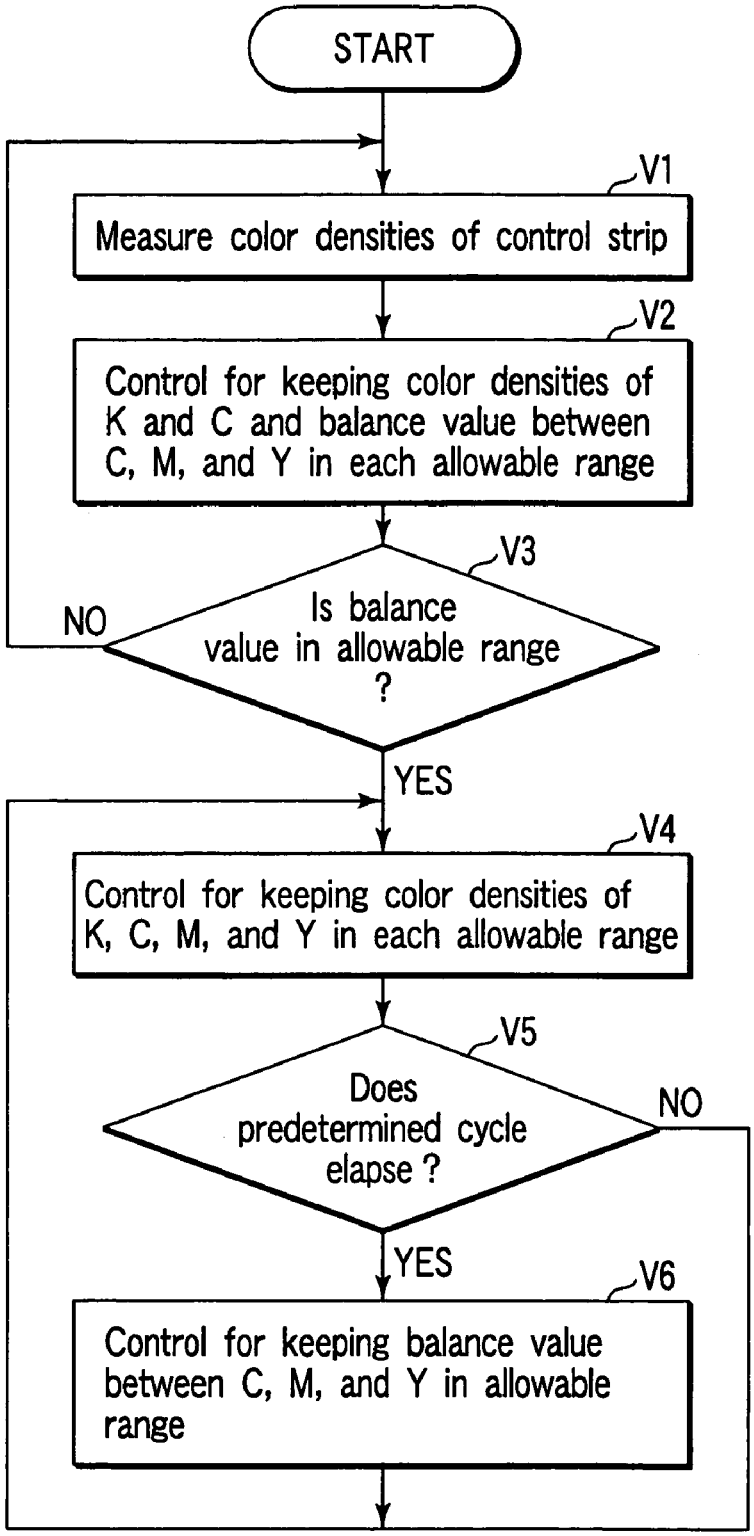
FIG. 18 is a flowchart showing an example of a printing method according to the fourth embodiment.

FIG. 18 is a flowchart showing an example of a printing method according to this embodiment.

In step V1, a measuring device measures the color densities of the control strip 20.

In step V2, the control device executes the control for keeping the color density of the patch 20C of one optional color selected from C, M, and Y (in the case of this embodiment, C is selected) and the color density of the patch 20K of K at a each target value or in an each allowable range in the width of each ink key and the control for keeping a value showing the balance between color densities of the patches 20C, 20M, and 20Y of three colors of C, M, and Y at a predetermined target value or in a balance allowable range.

In step V3, the control device repeats processings from the processing in step V1 downward until the value showing the balance becomes the predetermined target value or enters the balance allowable range.

When the value showing the balance becomes the target value or enters the balance allowable range, the control device executes the control for keeping the color densities of the patches 20K, 20C, 20M, and 20Y of K, C, M, and Y at a target value or in an allowable range respectively in the width of each ink key in step V4.

In step V5, the control device determines whether or not a predetermined cycle elapses.

When the predetermined cycle does not elapse, the control device repeats the processing from the processing in step V4 downward.

When the predetermined cycle elapses, the control device executes the control for keeping a value showing the balance between the color densities of the patches 20C, 20M, and 20Y of C, M, and Y at a target value or in a balance allowable range in step V6.

The printing method of this embodiment is described below in detail.

In the case of the printing method of this embodiment, an ink amount is controlled by using a color density satisfying a balance index on M and Y as a target on the basis of a color density of C at the start of printing.

As a result, the balance between three colors of C, M, and Y is improved, a printed matter superior in apparent color reproducibility is obtained, and it is possible to adjust the color hue most sensitive for a human eye.

Then, to make a printed matter to be controlled approach a target, the color densities of each color are independently managed together with the balance between three colors of C, M, and Y and controlled so that the color densities of each color is kept in an each allowable range.

As a result, color value and chroma showing the "intensity" of a color become close to a sample printed sheet and a high-quality printed matter is obtained.

EXAMPLE 1

Example 1 of the fourth embodiment is described below.

In the case of Example 1, the control for keeping the color density of any one of C, M, and Y and the color density of K at each preset reference color density is executed at the start of printing. Color densities of two colors among C, M, and Y are controlled as by assuming a color density satisfying a balanced index as a target color density. The balance index is calculated in accordance with measuring result of each patch of C, M, and Y.

After C, M, and Y enter each allowable range to each target color density, the ink-key control for making colors of K, C, M, and Y approach each target color density is executed and the balance index of three colors of C, M, and Y is regularly confirmed.

As a result, the time until a commercial printed matter is obtained after the start of printing is decreased and a preferable quality is kept until the printing is completed. Moreover, it is possible to decrease the number of printed sheets to be printed until a commercial product is obtained, the amount of ink used, and also decrease the total printing time.

Figure 19:
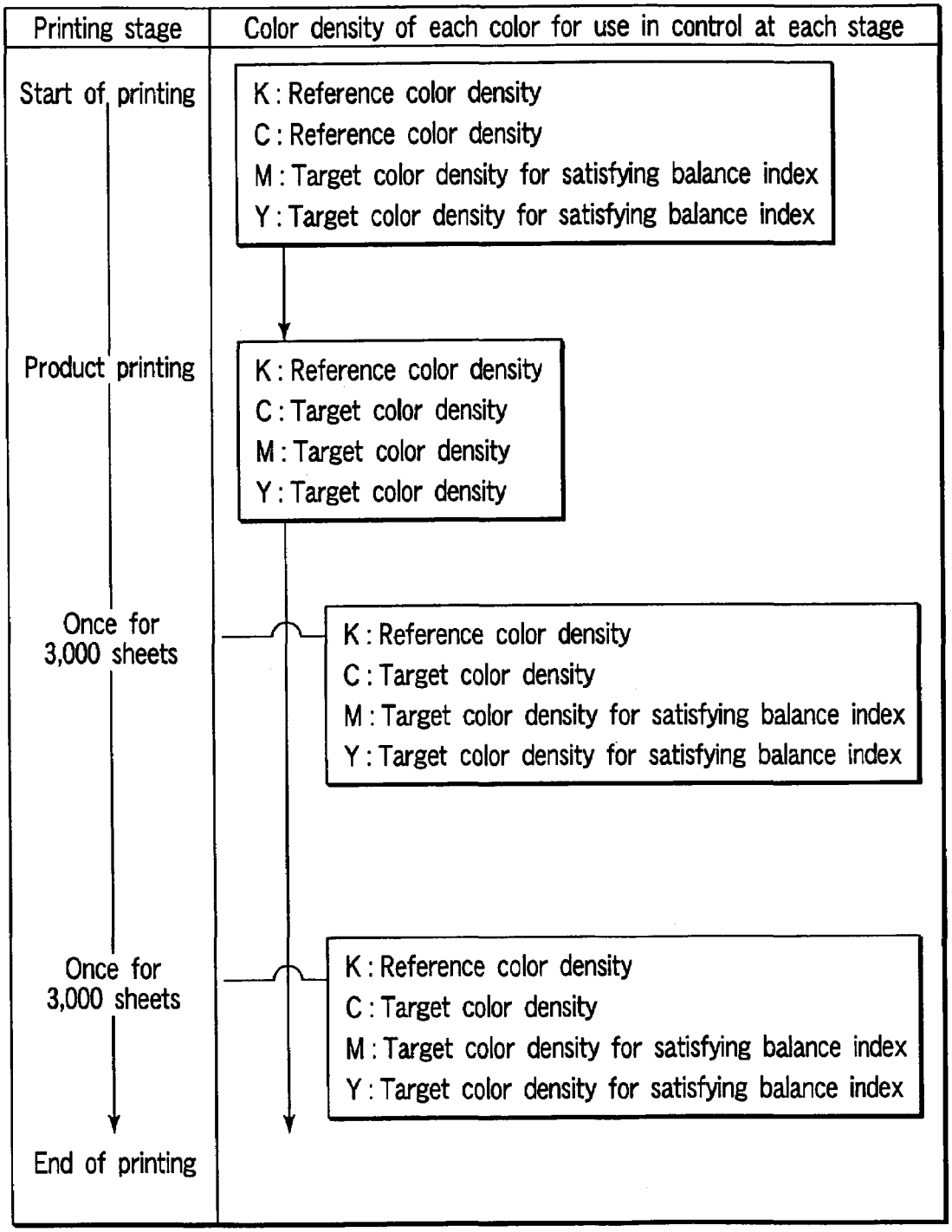
FIG. 19 is an illustration for explaining color densities of colors for use in printing steps of the printing method according to the fourth embodiment.

FIG. 19 is an illustration for explaining color densities of colors for use in printing stages of the printing method of this embodiment.

Though the color density of each color is used as a control factor in the case of this example 1, it is also allowed to use a color shown by CIELAB or the like as a control factor.

In the case of the printing method of this embodiment, the control considering the balance between C, M, and Y is executed at the start of printing and after a printed sheet serving as a commercial product is prepared and the quality is stabilized, the control for making colors of K, C M, and Y independently approach each target color density is executed.

The control considering the balance between C, M, and Y is executed whenever, for example, 3,000 sheets are printed.

As a result, the color density of each color enters a allowable range while keeping the balance between C, M, and Y and a printed matter having a stable quality is obtained.

In the case of this example, K is independently managed in accordance with a preset reference color density from the start to end of printing.

Thereby, the following three advantages are obtained.

(1) The productivity is improved because the time and the number of printing sheets necessary for color adjustment of K are decreased.

(2) Because the color density of K does not depend on an operator, the fluctuation of the color density of K is eliminated between lots or in one printed matter, and the printing quality is improved.

(3) Because a proper amount of ink is supplied onto a plate, the shadow part of K is prevented from too much dot gain due to too much K ink or the color density of K is prevented from lowering due to shortage of K ink. As a result, the gradation of the shadow part of K becomes rich and the printing quality is improved.

C, M, and Y excluding K are described in order below along printing stages.

At the start of printing, the control device controls the opening degree of ink keys by assuming a reference color density as a target. Moreover, the control device obtains a balance index on the basis of the color density of C in accordance with patch measurement results of C, M, and Y and controls an ink amount by assuming a color density satisfying the balance index on M and Y as a target color density.

An expression sensitive for a change of the balance between three colors of C, M, and Y is used to compute the balance index.

In the case of this example, the following expressions 3 are used:

$$\text{Balance index: } B=Dy(Dm-Dy)/Dc(Dc-Dm) \quad \text{(Expression 3)}$$

where B is a balance index, Dc is a cyan patch color density, Dm is a magenta patch color density, and Dy is a yellow patch color density.

It is also allowed to use the following Expression 4 in addition to the above Expression 3.

$$Dc:Dm:Dy=1:\alpha:\beta \quad \text{(Expression 4)}$$

In the above Expression 4, $\alpha$ and $\beta$ denote optional numerical values to be decided for cyan.

Thereby, the balance between C, M, and Y is kept and a printed sheet whose apparent reproducibility is close to a sample is early obtained.

When the balance between three colors of C, M, and Y and their color densities enter their allowable ranges, a printed sheet becomes a commercial product and the stage of product printing is started.

At the stage of product printing, the control device executes the control for making each of colors of C, M, and Y independently approach to each target color density.

As a result, a control logic for controlling an ink-key opening degree becomes simple. In addition, the ink-key opening degree is adjusted after patches of colors of the control strip are measured and the response speed until the color density of each color approaches a target rises.

Therefore, the color value and chroma showing the "intensity" of each color also approach a reference.

Then, the balance between C, M, and Y is confirmed whenever, for example, 3,000 sheets are printed and unless the balance between three colors is not resultantly kept in an allowable range, the control for each single color is stopped to restart the control considering the balance between three colors.

It is preferable that the timing for starting the control considering the balance between C, M, and Y is properly set in accordance with a state of a printing device, management rules of a printing plant, or agreement with a customer.

As a result, it is possible to keep the color density of each color in an allowable range and obtain a printed matter having a stable quality while keeping the balance between C, M, and Y.

Though the balance between three colors is confirmed and then, the control considering the balance between three colors is executed in the case of this embodiment, it is also allowed to regularly and forcibly perform the control considering the balance between three colors.

As described above, the present invention is effective for the technical field of a printing method of measuring color densities of patches included in a control strip and efficiently inspecting or managing the printing quality, the technical field of a printed matter used for the printing method, and the field of a printing control device for realizing the printing method.

What is claimed is:

1. A printing method of printing a control skip including patches on a printed matter, measuring color densities of patches, and performing printing control based on the color densities, wherein the patches are arranged in the same direction as the arrangement of ink keys of a printing device, the patches include four typical patches of black, cyan, magenta, and yellow at dot area rates of 80 to 85% in a width of each ink key, and the printing control is the control for keeping the color densities of the four typical patches of the width of each ink key in predetermined color-density ranges.

2. The printing method according to claim 1, wherein the dot area rates of the four typical patches are 80%.

3. The printing method according to claim 1, wherein the cyan and magenta typical patches are arranged at the middle of the width of each ink key.

4. A printing method of printing a control strip including patches on a printed matter, measuring color densities of the patches, and performing printing control based on the color densities, wherein the patches are arranged in the same direction as the arrangement of ink keys of a printing device, the patches include four typical patches of black at a dot area rate of 100%, and cyan, magenta and yellow at dot area rates of 80 to 85% in a width of each ink key, and the printing control is the control for keeping the color densities of the four typical patches of the width of each ink key in predetermined color-density ranges.

5. The printing method according to claim 4, wherein the dot area rates of the typical patches of cyan, magenta and yellow are 80%.

6. A printing method of printing a control strip including patches on a printed matter, measuring color densities of the patches, and performing printing control based on the color densities, wherein the patches are arranged in the same direction as the arrangement of ink keys of a printing device, and include four solid patches of black, cyan, magenta, and yellow at dot area rates of 100%, the patches include four typical patches of black, cyan, magenta, and yellow at dot area rates of 60 to 85% in a width of each ink key, and the printing control determines whether or not values obtained based on the color densities of the typical patches and the color densities of the solid patches are included in predetermined ranges on the four colors in the width of each ink key, and determines that printing is not normal when it is not determined that the values are included in the ranges.

7. The printing method according to claim 6, wherein the control strip includes the four typical patches and the four solid patches in the width of each ink key.

8. The printing method according to claim 6, wherein the printing control outputs an alarm and stops opening/closing control of the ink keys of the printing device, when it is determined that the printing is not normal.

9. A printing method of printing a control slip including patches on a printed matter, measuring color densities of the patches, and performing printing control based on the color densities, wherein the patches are arranged in the same direction as the arrangement of ink keys of a printing device, and include four solid patches of black, cyan, magenta, and yellow at dot area rates of 100% and four middle patches of black, cyan, magenta, and yellow at dot area rates of 40 to 50%, the patches include four typical patches of black, cyan, magenta and yellow at dot area rates of 60 to 85% in a width of each ink key, and the printing control determines on the four colors whether or not values obtained based on differences between the color densities of the solid patches and the color densities of the typical patches and differences between the color densities of the typical patches and the color densities of the middle patches are included in predetermined ranges in the width of each ink key, and determines that printing is not normal when it is not determined that the values are included in the ranges.

10. The printing method according to claim 9, wherein the control slip includes the four typical patches, the four solid patches, and the four middle patches in the width of each ink key.

11. The printing method according to claim 9, wherein the printing control outputs an alarm and stops opening/closing control of the ink keys of the printing device, when it is determined that the printing is not normal.

12. A printing method of printing a control strip including patches on a printed matter, measuring color densities of the patches, and controlling ink keys provided for a printing device based on the color densities, comprising:

measuring the color densities of four patches of black, cyan, magenta, and yellow included in a width of each ink key;

controlling the ink keys for keeping the color density of the patch of an optical color selected from cyan, magenta, and yellow and the color density of the patch of black in predetermined color-density ranges and keeping a value showing the balance of the color densities of cyan, magenta, and yellow patches in a predetermined range in the width of each ink key, and controlling the ink keys for keeping the color densities of black, cyan, magenta, and yellow patches in the color-density ranges in the width of each ink key and obtaining a value showing the balance of the color densities of cyan, magenta, and yellow patches at each predetermined cycle, after the value showing the balance enters in the range.

13. The printing method according to claim 12, further comprising:

controlling the ink keys for keeping the value showing the balance obtained at each predetermined cycle in the range in the width of each ink key.

14. A printed matter on which a control strip including patches is printed, wherein the patches are arranged in the same direction as the arrangement of ink keys of a printing device under printing, and the patches include four typical patches of black, cyan, magenta, and yellow at dot area rates of 80 to 85% in a width of each ink key.

15. The printed matter according to claim 14, wherein dot area rates of the four typical patches are 80%.

16. The printed matter according to claim 14, wherein typical patches of cyan and magenta are arranged at the middle of the width of each ink key.

17. A printed matter on which a control strip including patches is printed, wherein the patches are arranged in the same direction as the arrangement of ink keys of a printing device under printing, and the patches include four typical patches of black at a dot area rate of 100% and cyan, magenta, and yellow at dot area rates of 80 to 85% in a width of each ink key.

18. The printed matter according to claim 17, wherein the dot area rates of the typical patches of cyan, magenta and yellow are 80%.

19. A printed matter on which a control strip including patches is printed, wherein the patches are arranged in the same direction as the arrangement of ink keys of a printing device under printing, the patches include four typical patches of black, cyan, magenta, and yellow at dot area rates of 60 to 85% in a width of each ink key, and the patches include four solid patches of black, cyan, magenta, and yellow at dot area rates of 100% in the width of each ink key.

20. The printed matter according to claim 19, wherein the control strip includes the four typical patches and the four solid patches in the width of each ink key.

21. A printed matter on which a control strip including patches is printed, wherein the patches are arranged in the same direction as the arrangement of ink keys of a printing device under printing, the patches include four typical patches of black, cyan, magenta, and yellow at dot area rates of 60 to 85% in a width of each ink key, and the patches include four solid patches of black, cyan, magenta, and yellow at dot area rates of 100% and four middle patches of black, cyan, magenta, and yellow at dot area rates of 40 to 50%.

22. The printed matter according to claim 21, wherein the control strip includes the four typical patches, the four solid patches, and the four middle patches in the width of each ink key.

23. A printing control device for printing a control strip including patches on a printed matter, measuring color densities the patches, and performing printing control based on the color densities, wherein the patches are arranged in the same direction as the arrangement of ink keys of a printing device, and the patches include four typical patches of black, cyan, magenta, and yellow at dot area rates of 80% to 85% in a width of each ink key, the printing control device comprising:

a measuring section which measures the color densities of the patches; and a control section which performs the control for keeping the color densities of the four typical patches in predetermined color-density ranges in the width of each ink key.

24. The printing control device according to claim 23, wherein the dot area rates of the four typical patches are 80%.

25. The printing control device according to claim 23, wherein the typical patches of cyan and magenta are arranged at the middle of the width of each ink key.

26. A printing control device for printing a control strip including patches on a printed matter, measuring color densities of the patches, and performing printing control based on the color densities, wherein the patches are arranged in the same direction and the arrangement of ink keys of a printing device, and the patches include four typical patches of black at a dot area rate of 100% and cyan, magenta, and yellow at dot area rates of 80 to 85% in a width of each ink key, the printing control device comprising:

a measuring section which measures the color densities of the patches; and a control section which performs the control for keeping the color densities of the four typical patches in predetermined color-density ranges in the width of each ink key.

27. The printing control device according to claim 26, wherein the dot area rates of the typical patches of cyan, magenta and yellow are 80%.

28. A printing control device for printing a control strip including patches on a printed matter, measuring color densities of the patches, and performing printing control based on the color densities, wherein the patches are arranged in the same direction as the arrangement of ink keys of a printing device, and include four solid patches of black, cyan, magenta, and yellow at dot area rates of 100%, and the patches include four types of typical patches of black, cyan, magenta, and yellow at dot area rates of 60 to 85% in a width of each ink key, the printing control device comprising:

a measuring section which measures the color densities of the patches; and a control section which determines on the four colors whether or not values obtained based on the color densities of the typical patches and the color densities of the solid patches are included in predetermined ranges on the four colors in the width of each ink key, and determines that printing is not normal when it is not determined that the values are included in the ranges.

29. The printing control device according to claim 28, wherein the control strip includes the four typical patches and the four solid patches in the width of each ink key.

30. The printing control device according to claim 28, wherein the control section outputs an alarm and stops opening/closing control of the ink keys of the printing device, when it is determined that the printing is not normal.

31. A printing control device for printing a control strip including patches on a printed matter, measuring color densities of the patches, and performing printing control based on the color densities, wherein the patches are arranged in the same direction as the arrangement of ink keys of a printing device, and include four solid patches of black, cyan, magenta, and yellow at dot area rates of 100% and four middle patches of black, cyan, magenta, and yellow at dot area rates of 40 to 50%, and the patches include four typical patches of black, cyan, magenta, and yellow at dot area rates of 60 to 85% in a width of each ink key, the printing control device comprising:

a measuring section which measures the color densities of the patches; and a control section which determines on the four colors whether or not values obtained based on differences between the color densities of the solid patches and the color densities of the typical patches and differences between the color densities of the typical patches and the color densities of the middle patches are included in predetermined ranges in the width of each ink key, and determines that printing is not normal when it is not determined the values are included in the ranges.

32. The printing control device according to claim 31, wherein the control strip includes the four typical patches and the four solid patches, and the four middle patches in the width of each ink key.

33. The printing control device according to claim 31, wherein the control section outputs an alarm and stops opening/closing control of the ink keys of the printing device, when it is determined that the printing is not normal.

34. A printing control device for printing a control strip including patches on a printed matter, measuring color densities of the patches, and controlling ink keys provided for a printing device based on the color densities, comprising:

a measuring section which measures the color densities of the patches; and a control section which controls the ink keys respectively for keeping the color density of the patch of an optional color selected from cyan, magenta, and yellow and the color density of the black patch in predetermined color-density ranges and keeping a value showing the balance of the color densities of cyan, magenta, and yellow patches in a predetermined range in a width of each ink key, and controls the ink keys respectively for keeping the color densities of black, cyan, magenta, and yellow patches in the color-density ranges in the width of each ink key and obtains a value showing the balance of the color densities of cyan, magenta, and yellow patches at each predetermined cycle, after the value showing the balance enters in the range.

35. The printing control device according to claim 34, wherein the control section controls ink keys for keeping the value showing the balance obtained at each the predetermined cycle in the range in the width of each ink key.

* * * * *

UNITED STATES PATENT AND TRADEMARK OFFICE

CERTIFICATE OF CORRECTION

PATENT NO. : 6,983,695 B2
APPLICATION NO. : 10/762286
DATED : January 10, 2006
INVENTOR(S) : Masao Mogi et al.

It is certified that error appears in the above-identified patent and that said Letters Patent is hereby corrected as shown below:

Column 24, Line 2, after "control" delete "skip" and insert - - strip - - therefor; and
Column 24, Line 61, after "control" delete "slip" and insert - - strip - - therefor; and
Column 25, Line 17, after "control" delete "slip" and insert - - strip - - therefor.

Signed and Sealed this

Twenty-second Day of August, 2006

JON W. DUDAS
*Director of the United States Patent and Trademark Office*